US011565168B2

(12) United States Patent
Moronta Blanco et al.

(10) Patent No.: US 11,565,168 B2
(45) Date of Patent: Jan. 31, 2023

(54) SKATEBOARD SYSTEMS AND METHODS

(71) Applicant: Cruz Control Skate Company, LLC, Franklin, MA (US)

(72) Inventors: Leonardo Alberto Moronta Blanco, Boston, MA (US); Mark Augustine Puglia, Townsend, MA (US); Cameron Kyle Kunde, Ojai, CA (US); Seamus Scott Winters, Cranston, RI (US); Trevor Gerard Danna, Boston, MA (US); Christian Miles Etherton, Boston, MA (US); Max Thomas Marcel Heudebourg, Boston, MA (US); Eamon Joseph McCarthy, Walpole, MA (US); Lucas Aidan Sonnergaard McGahren, Boston, MA (US)

(73) Assignee: Cruz Control Skate Company, LLC, Franklin, MA (US)

( * ) Notice: Subject to any disclaimer, the term of this patent is extended or adjusted under 35 U.S.C. 154(b) by 0 days.

(21) Appl. No.: 17/142,053

(22) Filed: Jan. 5, 2021

(65) Prior Publication Data

US 2021/0213350 A1 Jul. 15, 2021

Related U.S. Application Data

(60) Provisional application No. 62/961,561, filed on Jan. 15, 2020.

(51) Int. Cl.

| | |
|---|---|
| ***A63C 17/00*** | (2006.01) |
| ***A63C 17/14*** | (2006.01) |
| ***A63C 17/01*** | (2006.01) |

(52) U.S. Cl.

CPC ..... *A63C 17/0046* (2013.01); *A63C 17/012* (2013.01); *A63C 17/1418* (2013.01)

(58) Field of Classification Search

CPC ..... A63C 17/0046; A63C 17/012; A63C 17/1418

See application file for complete search history.

(56) References Cited

U.S. PATENT DOCUMENTS 4,123,080 A * 10/1978 Agajanian ..... A63C 17/015 280/220

4,155,565 A 5/1979 De Caussin (Continued)

OTHER PUBLICATIONS

GBomb Longboards skateboard components, published online at www.gbomblongboards.com at least as early as Aug. 19, 2018, available at the Internet Archive (web.archive.org) at the URLs listed at the bottom of the pages, last visited Dec. 17, 2020.

(Continued)

*Primary Examiner* — Brian L Swenson

(74) *Attorney, Agent, or Firm* — David R. Stevens; Stevens Law Group

(57) ABSTRACT

A skateboard system includes a first suspension member having first through third portions, each portion having a largest flat planar surface. The first portion includes a plurality of mount holes to mount it with a skateboard deck. The largest flat planar surface of the second portion is angled between fifteen and sixty degrees relative to the largest flat planar surface of the first portion and relative to the deck. The largest flat planar surface of the third portion is angled between fifteen and eighty degrees relative to the largest flat planar surface of the second portion. The third portion includes at least one opening to mount a truck assembly and/or a hanger with the third portion. The first suspension member flexes, such that an angle between the largest flat planar surface of the second portion and the deck decreases, in response to a first downward force on the deck.

20 Claims, 23 Drawing Sheets

(56) References Cited

U.S. PATENT DOCUMENTS

| | | | | |
|---|---|---|---|---|
| 6,318,739 | B1 | 11/2001 | Fehn | |
| 7,896,364 | B1 * | 3/2011 | Ferreira | A63C 17/064 280/11.27 |
| 2008/0252026 | A1 * | 10/2008 | Kang | A63C 17/0093 280/11.27 |
| 2010/0140885 | A1 * | 6/2010 | Corrente | A63C 17/015 280/11.27 |
| 2012/0146304 | A1 * | 6/2012 | Fehn | A63C 17/0046 29/525.01 |
| 2017/0087441 | A1 | 3/2017 | Ivazes | |
| 2017/0282051 | A1 | 10/2017 | Meyer | |
| 2018/0250581 | A1 | 9/2018 | Lemire-Elmore et al. | |
| 2019/0030416 | A1 * | 1/2019 | Dumas | A63C 17/0046 |

OTHER PUBLICATIONS

GBomb Longboards skateboard components, published online at www.gbomblongboards.com at least as early as Dec. 17, 2020, available online at the GBomb website at the URLs listed at the bottom of the pages, last visited Dec. 17, 2020.

Avenue Trucks skateboard components, published online at www.avenuetrucks.com at least as early as Feb. 16, 2019, available online at the Avenue Trucks website at the URLs listed at the bottom of the pages, last visited Dec. 17, 2020.

* cited by examiner

SKATEBOARD SYSTEMS AND METHODS

CROSS REFERENCE TO RELATED APPLICATIONS

This document claims the benefit of the filing date of U.S. Provisional Patent Application No. 62/961,561, entitled "Suspension and Braking System for Skateboards," naming as first inventor Leonardo Alberto Moronta Blanco, which was filed on Jan. 15, 2020, the disclosure of which is hereby incorporated entirely herein by reference.

BACKGROUND

1. Technical Field

Aspects of this document relate generally to skateboards. Specific aspects relate to suspension systems for skateboards. Specific aspects relate to braking systems for skateboards.

2. Background Art

Skateboards are used for transportation and recreation. Skateboards generally include a deck, two truck assemblies coupled with the deck (each truck assembly including or coupled with a skateboard hanger and an axle), and wheels coupled with the axles. Some suspension members exist in the art to provide suspension between the wheels and the deck of the skateboard. Other methods exist for raising wheels of a skateboard relative to the deck, to bring them vertically closer to the deck and/or on a common plane with the deck.

SUMMARY

Implementations of skateboard systems may include: a first suspension member including: a first portion having a largest flat planar surface configured to mate flush with an underside of a deck of a skateboard, the first portion having a plurality of mount holes configured to allow mounting of the first portion with the deck; a second portion having a largest flat planar surface angled between fifteen and sixty degrees relative to the largest flat planar surface of the first portion and relative to the deck in an installed configuration; and a third portion having a largest flat planar surface angled between fifteen and sixty degrees relative to the largest flat planar surface of the second portion, the third portion having at least one opening configured to mount a skateboard truck assembly and/or a skateboard hanger with the third portion; wherein the first suspension member is configured to increase a vertical distance between the deck and a wheel of the skateboard in the installed configuration, relative to a configuration where the skateboard truck assembly is mounted directly with the deck; and wherein the first suspension member is configured to flex, such that an angle between the largest flat planar surface of the second portion and the deck decreases by between five and thirty degrees in response to a first downward force on the deck, the first downward force provided at least in part by a user's feet during riding.

Implementations of skateboard systems may include one or more or all of the following:

All of the first suspension member may be formed from a single piece of metal.

The single piece of metal may have a Rockwell hardness between 35 and 55.

The first portion, the second portion, and the third portion may each be substantially flat.

The first portion, the second portion, and the third portion may each be fully flat.

The second portion may be configured to flex in a direction opposite a direction of flexion of the deck in response to the first downward force.

The first suspension member may be configured to twist in response to the user alternating between a toeside downward force and a heelside downward force, the twisting configured to assist propelling the skateboard.

A braking member may be included and may be configured to mount with the first suspension member, the braking member configured to abut the wheel of the skateboard in response to a second downward force on the deck, the second downward force provided at least in part by the user's feet during riding. The second downward force may be a partially-downward force and may be applied by a leaning motion of the user, leaning back on a tail of the deck.

The braking member may include a lever configured to rotate, to abut the braking member to the wheel, in response to the second downward force.

The system may include the deck and a second suspension member. A distance between a mounting location of the first suspension member to the deck and a mounting location of the second suspension member to the deck, in the installed configuration, may have a length less than half a longest length of the deck.

The distance between the mounting location of the first suspension member to the deck and the mounting location of the second suspension member to the deck may have a length less than a third the longest length of the deck.

Implementations of skateboard systems may include: a first suspension member including: a first portion having a largest flat planar surface configured to mate flush with an underside of a deck of a skateboard, the first portion including a plurality of mount holes configured to allow mounting of the first portion with the deck; a second portion having a largest flat planar surface angled between fifteen and sixty degrees relative to the largest flat planar surface of the first portion and relative to the deck in an installed configuration; and a third portion having a largest flat planar surface angled between fifteen and sixty degrees relative to the largest flat planar surface of the second portion, the third portion including a plurality of mount holes sized and spaced to align with mount holes of a skateboard truck assembly to facilitate mounting of the skateboard truck assembly with the third portion; wherein the first suspension member is configured to increase a vertical distance between the deck and a wheel of the skateboard, in the installed configuration, relative to a configuration where the skateboard truck assembly is mounted directly with the deck; and wherein the first suspension member is configured to flex, such that an angle between the largest flat planar surface of the second portion and the deck decreases by between five and thirty degrees, in response to a first downward force on the deck, the first downward force provided at least in part by a user's feet during riding. It is pointed out here that the first downward force could be due to the feet of the rider pressing down on the deck or it could be from the deck being pressed upwards towards the feet of the ride (such as from a rough road underneath the deck). In either case (the feet causing the deck to be pushed downward or the road pushing the deck upwards towards the feet) the feet will provide a downward force on the deck.

Implementations of skateboard systems may include one or more or all of the following:

An opening may be included in the third portion and may provide access to a kingpin bolt of the skateboard truck assembly when the skateboard truck assembly is mounted with the first suspension member.

The largest flat planar surface of the first portion may be within fifteen degrees of being parallel with the largest flat planar surface of the third portion when the first suspension member is in a non-flexed state.

All of the first suspension member may consist of a single flat piece of metal with bends to separate the first portion, the second portion, and the third portion, and a plurality of openings through the single flat piece of metal including the plurality of mount holes of the first portion and the plurality of mount holes of the third portion.

Implementations of skateboard systems may include: a first suspension member including: a first portion having a largest flat planar surface configured to mate flush with an underside of a deck of a skateboard, the first portion including a plurality of mount holes configured to allow mounting of the first portion with the deck; a second portion having a largest flat planar surface angled between fifteen and sixty degrees relative to the largest flat planar surface of the first portion and relative to the deck in an installed configuration; a third portion having a largest flat planar surface angled between fifteen and sixty degrees relative to the largest flat planar surface of the second portion, the third portion having an opening sized to receive a kingpin bolt for coupling a skateboard hanger with the third portion; and a fourth portion having a largest flat planar surface angled between fifteen and eighty (in some implementations between thirty-five and seventy, or between forty and sixty) degrees relative to the largest flat planar surface of the third portion, the fourth portion including a pivot cup configured to receive a pivot member of the skateboard hanger and/or an opening configured to receive the pivot cup; wherein the first suspension member is configured to increase a vertical distance between the deck and a wheel of the skateboard in the installed configuration, relative to a configuration where a skateboard truck assembly including the skateboard hanger is mounted directly with the deck; and wherein the first suspension member is configured to flex, such that an angle between the largest flat planar surface of the second portion and the deck decreases by between five and thirty degrees, in response to a first downward force on the deck, the first downward force provided at least in part by a user's feet during riding.

Implementations of skateboard systems may include one or more or all of the following:

The first portion, the second portion, the third portion and the fourth portion may each be substantially flat.

The pivot cup may be fixedly coupled with the fourth portion.

Going in a direction from the first portion to the fourth portion, in the installed configuration the first portion may be flush with the deck, the second portion may be angled downward away from the deck, the third portion may be angled upward towards the deck, and the fourth portion may be angled downward away from the deck.

The system may further include the kingpin bolt. The kingpin bolt may have a stepped configuration forming a surface configured to mate with a surface of a bushing through which the kingpin bolt passes when the first suspension member is in the installed configuration.

General details of the above-described implementations, and other implementations, are given below in the DESCRIPTION, the DRAWINGS, and the CLAIMS.

BRIEF DESCRIPTION OF THE DRAWINGS

Implementations will be discussed hereafter using reference to the included drawings, briefly described below, wherein like designations refer to like elements. The drawings are not necessarily drawn to scale.

DESCRIPTION

Implementations/embodiments disclosed herein (including those not expressly discussed in detail) are not limited to the particular components or procedures described herein. Additional or alternative components, assembly procedures, and/or methods of use consistent with the intended skateboard systems and methods may be utilized in any implementation. This may include any materials, components, sub-components, methods, sub-methods, steps, and so forth.

Figure 1:
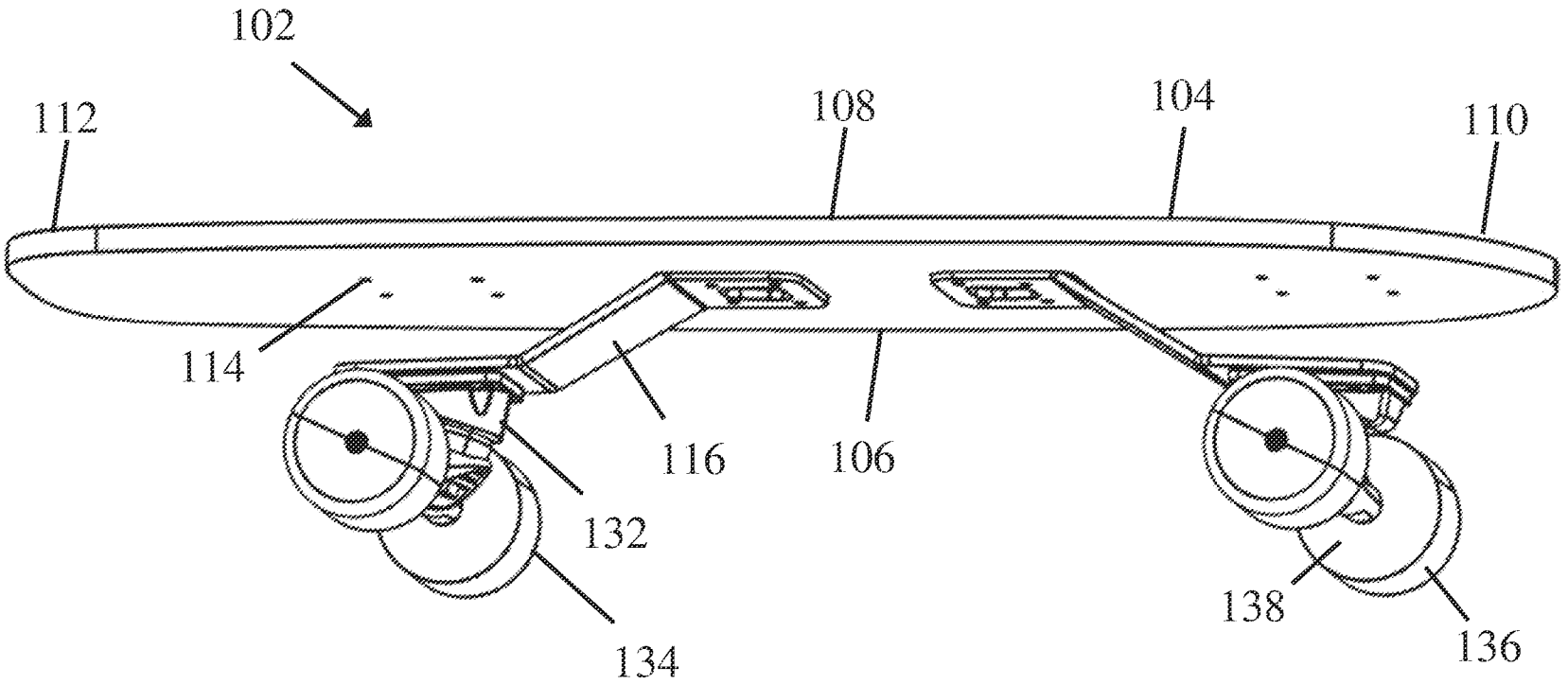
FIG. 1 is a side perspective view of an implementation of a skateboard system.

Referring to FIG. 1, an implementation of a skateboard system (skateboard) (system) 102 is illustrated. System 102 includes a deck 104 having a nose 110, tail 112, toeside 106 and heelside 108 (though the toeside and heelside sides alternate depending on the preference of the rider). Truck mounting holes 114 may be included in the deck or may be excluded. A conventional skateboard would have truck assemblies 132 coupled with the deck using the truck mounting holes. Indeed, skateboard decks are often purchased separately and come with truck mounting holes pre-drilled or otherwise included.

With system 102, however, a pair of suspension members 116 are coupled with the deck and the truck mounting assemblies are, in turn, coupled with the suspension members. The truck mounting assemblies include a hanger and an axle (or an axle receiver) and wheels 134 are coupled with the axles. Each wheel includes a riding surface 136 and an inner sidewall 138 (and an outer sidewall, not called out in FIG. 1).

In FIG. 1 it can be seen that the suspension members are coupled with the deck nearer a center of the deck than the conventional truck mounting holes. It can also be seen that the truck assemblies are horizontally not displaced (or not substantially displaced) relative to where they would normally be, but the truck assemblies are vertically displaced when the system is in an installed configuration (as shown in FIG. 1) so that a vertical distance between the wheels and the deck is increased. In other implementations, however, the truck assemblies could be horizontally displaced to any desirable position/configuration to adjust the wheelbase relative to the deck.

Figure 2:
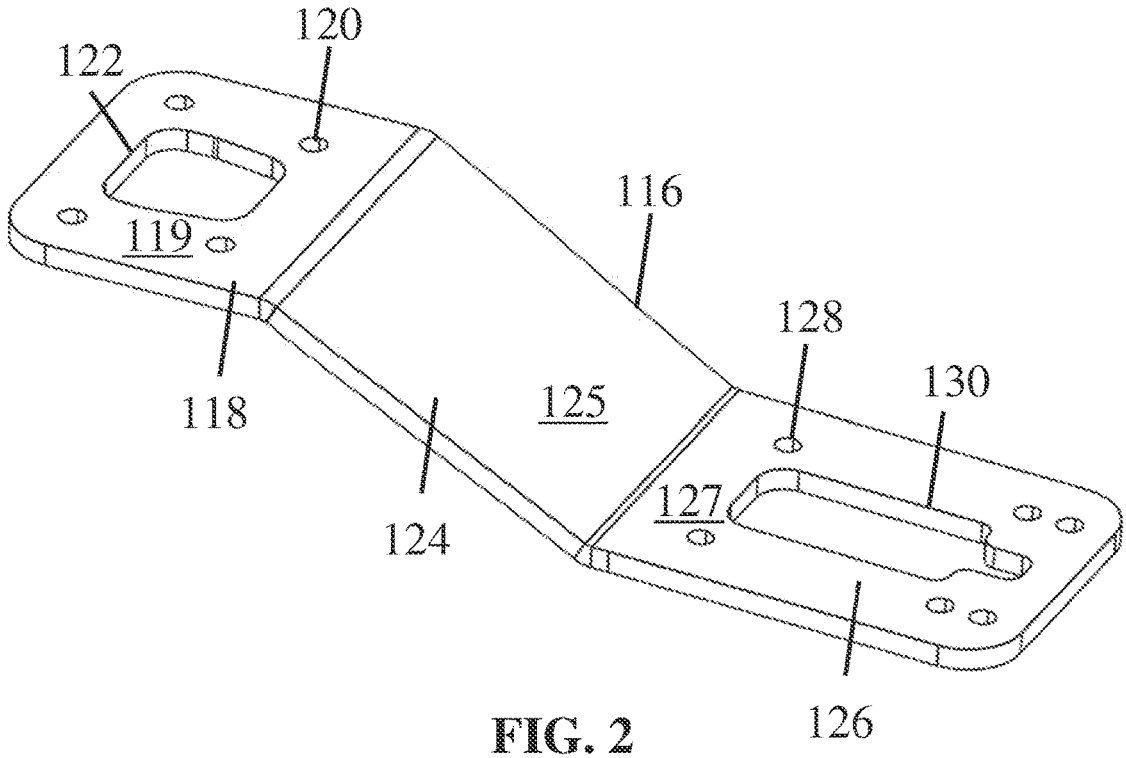
FIG. 2 is a side perspective view of a suspension member of the system of FIG. 1.

FIG. 2 shows an illustration of one of the suspension members 116, which includes a first portion 118 having a largest flat planar surface 119 and a plurality of mount holes 120 for mounting the first portion to the deck. The suspension member also includes an opening 122 which may serve no functional purpose other than decreasing a weight of the suspension member and/or reducing material costs. The suspension member includes a second portion 124 having a largest flat planar surface 125. The suspension member includes a third portion 126 having a largest flat planar surface 127 and a plurality of mount holes 128 to facilitate mounting of a truck assembly to the third portion. The mount holes are accordingly configured to align with mount holes of a truck assembly. In implementations not all of the mount holes may be used (for example in implementations only four of the mount holes 128 may be used in mounting the third portion to a truck assembly), but the additional mount holes may be useful, for example, for mounting with truck assemblies of different sizes or for mounting with truck assemblies having different mount hole configurations. Older bolt hole configurations (for older truck styles) may need to use the outermost four bolt holes, while newer truck configurations (shortened to allow for more clearance when doing grinds) may have a shorter bolt hole configuration and may accordingly use bolt holes closer to one another.

The third portion also includes an opening 130, which may reduce weight and material costs of the suspension member but, also, may allow a user access to a kingpin of a truck assembly through the opening. This may allow a user to leave a baseplate of a truck assembly attached to the suspension member while removing other portions of the truck assembly, such as a hanger, axle, bushings, and so forth. In implementations the opening 130 may not be sized large enough to allow a user to access the kingpin (such as with a socket or the like) and may be only for reduced weight and material costs of the suspension member. Additionally, in implementations a nut may be removed from the kingpin bolt to effectively disassemble the truck assembly, while leaving a baseplate of the truck assembly attached to the suspension member, without the user needing to access a head of the kingpin bolt through the opening 130.

Figure 3:
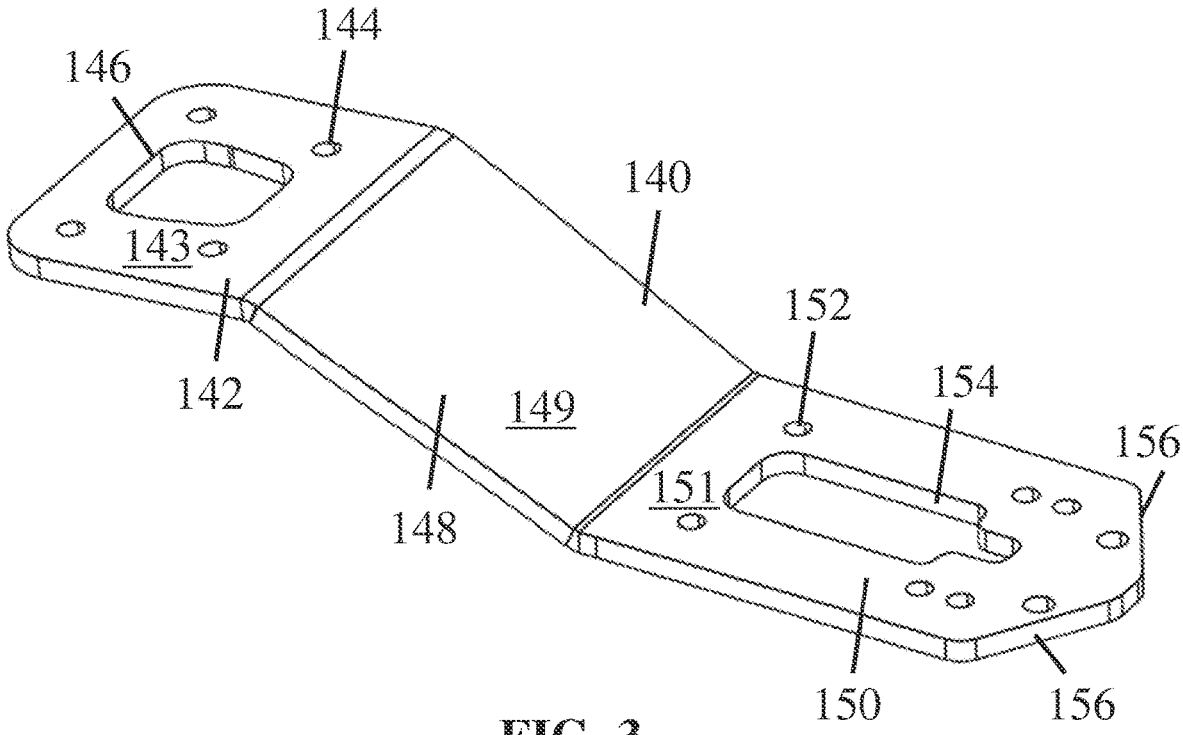
FIG. 3 is a side perspective view of another implementation of a suspension member.

FIG. 3 shows another version of a suspension member, which in many respects is similar to suspension member 116. Suspension member 140 includes a first portion 142 having a largest flat planar surface 143, mount holes 144 and an opening 146, a second portion 148 having a largest flat planar surface 149, and a third portion 150 having a largest flat planar surface 151, mount holes 152, and an opening 154. These elements may serve the same purposes as those described above with respect to suspension member 116. It is seen that the third portion of suspension member 140 includes angled edges 156 and two additional mount holes relative to suspension member 116. The additional mount holes may be useful, for example, for mounting additional components such as one or more brake members/assemblies and/or one or more rubber bumpers (not shown in the drawings) to dampen impacts between the suspension member(s) and the deck (such as when the suspension member "bottoms out" from a strong downward force.

Figure 4:
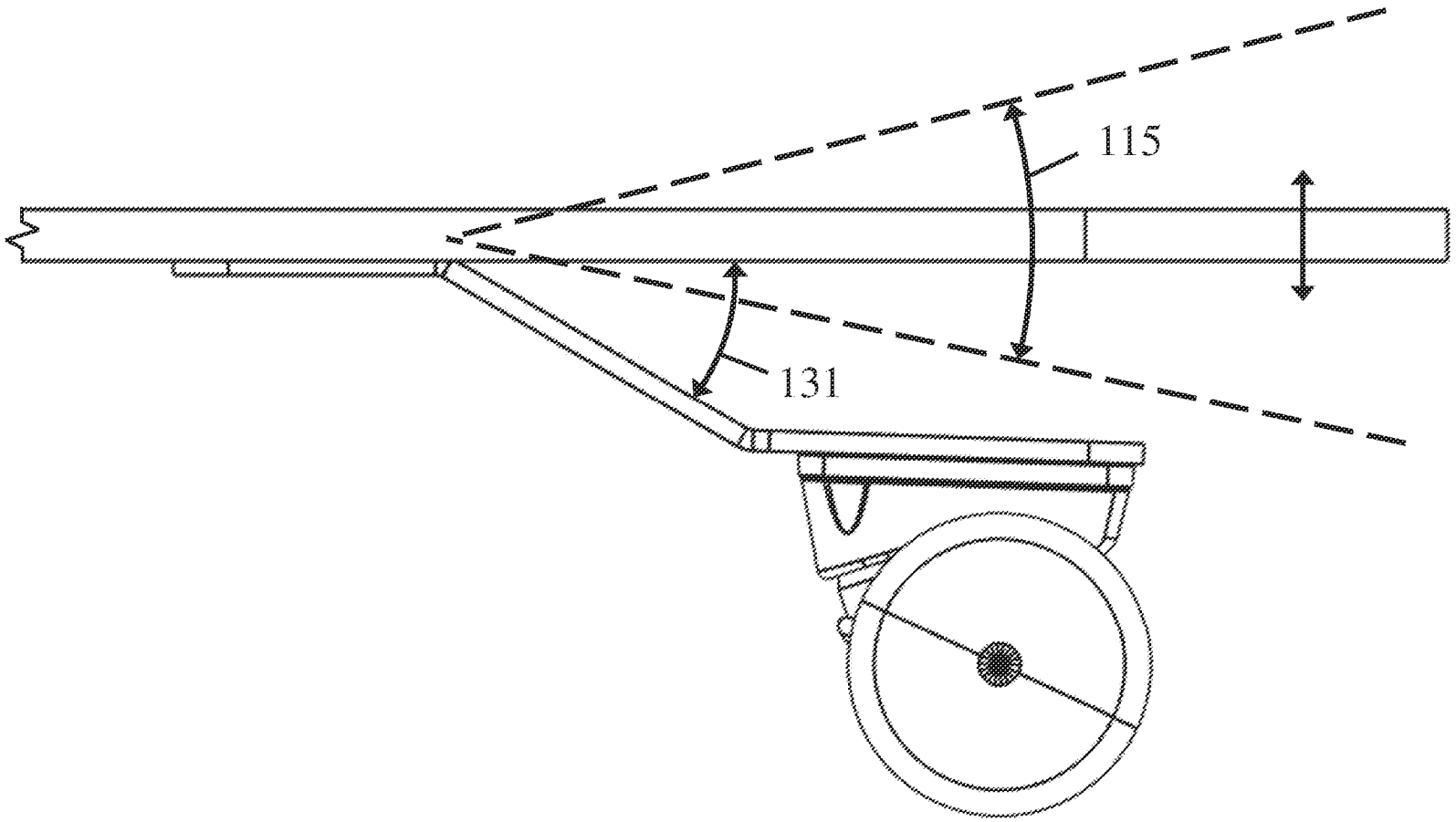
FIG. 4 is a partial side view of the system of FIG. 1.

FIG. 4 shows a partial side view of system 102. It can be seen that the first portion of the suspension member 116 is flush with the deck in an installed configuration, and that the second portion forms an angle 131 relative to the deck (and relative to the first portion). The suspension member is configured to flex so that the angle 131 decreases and increases with a downward force and with a corresponding rebounding upward force, respectively, on the deck (the forces representatively illustrated with the rightmost double arrow). Additionally, the deck itself is configured to have a flexion 115 in response to the downward and upward forces. For example, a user may use his/her foot to press down on the tail or nose of the deck to flex the deck (or a portion of the deck) downwards. This will cause the second portion of the suspension member to flex upwards, opposite the downward flexion of the deck, and the flexion of the deck and the second portion will accordingly together reduce the angle 131 between the deck and the second portion.

Figure 6:
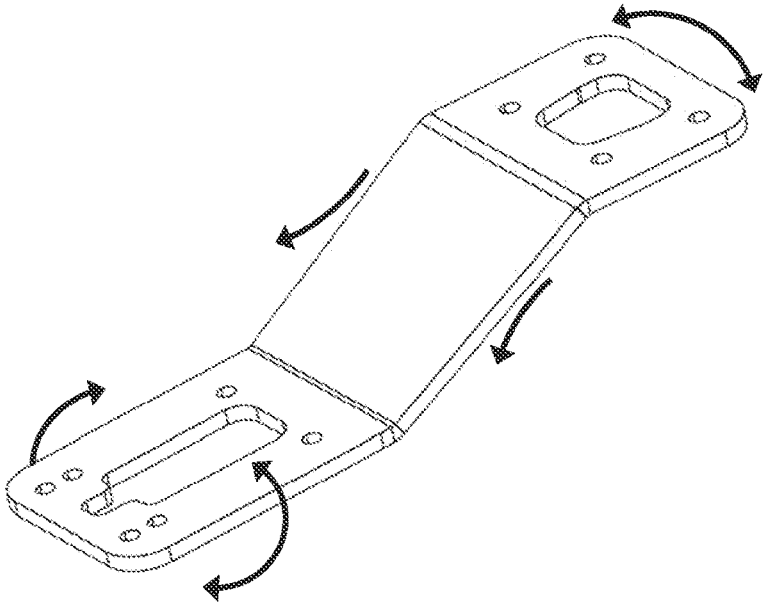
FIG. 6 is another side perspective view of the suspension member of FIG. 2.

Additionally, in response to the downward force the third portion may flex relative to the second portion (increasing a largest angle between those two portions). The flexion of the second portion relative to the first portion also increases a largest angle between those two portions in response to the downward force. Because the largest angles between the first portion and second portion, and between the second portion and third portion, respectively, are increased in response to the downward force, the suspension member may also be elongated in response to this force, such that the first portion and third portion become more distant from one another. This motion/flexion is represented in FIG. 6 by the middle downward arrows to the sides of the second portion.

Naturally, when the downward force stops and when an upward rebound force is present, the reverse mechanisms occur: the largest angles between the first and second portions, and between the second and third portions, may decrease; the first portion and third portion may be brought nearer to one another; the angle 131 may increase, and so forth. The direction of flexion of the suspension member in that case may, again, be opposite a direction of flexion of the deck, as the suspension member may be flexing in a downward direction while the deck is flexing in an upward direction.

In implementations the angle 131 in a resting, non-flexed configuration (with no rider weight) may be between fifteen and sixty (in some cases between fifteen and fifty, or between twenty and forty-five) degrees. In the implementation shown in the drawings the angle 131 is thirty degrees in a resting position (with no rider weight). In implementations the combined flexion of the suspension member and the deck during riding and/or during tricks may reduce the angle 131 by between five and thirty degrees. In other implementations the riding/tricks may reduce the angle by between other amounts, such as between ten and thirty degrees, fifteen and thirty degrees, twenty and thirty degrees, twenty-five and thirty degrees, and so forth. In implementations wherein the angle 131 in a resting condition is greater than thirty degrees (such as forty-five degrees) the riding/tricks could reduce the angle by such amounts as between five and forty-five degrees, ten and forty-five degrees, fifteen and forty-five degrees, twenty and forty-five degrees, twenty-five and forty-five degrees, thirty and forty-five degrees, thirty-five and forty-five degrees, forty and forty-five degrees, and so forth.

In implementations the combined flexion of the suspension member and the deck may be such that the suspension member "bottoms out" and the angle reduces to zero during riding (such as during user tricks, jumps, etc. which involve a forceful landing or otherwise provide a strong enough downward force on the deck). During bottoming out the second portion may be flush or substantially flush with the deck and the third portion may also be flush or substantially flush with the deck. The ability of the suspension member to flex in this way increases comfort during a skateboard ride for the user. The suspension also provides cushioning from bumps, cracks, etc., in surfaces on which the skateboard is ridden.

Figure 5:
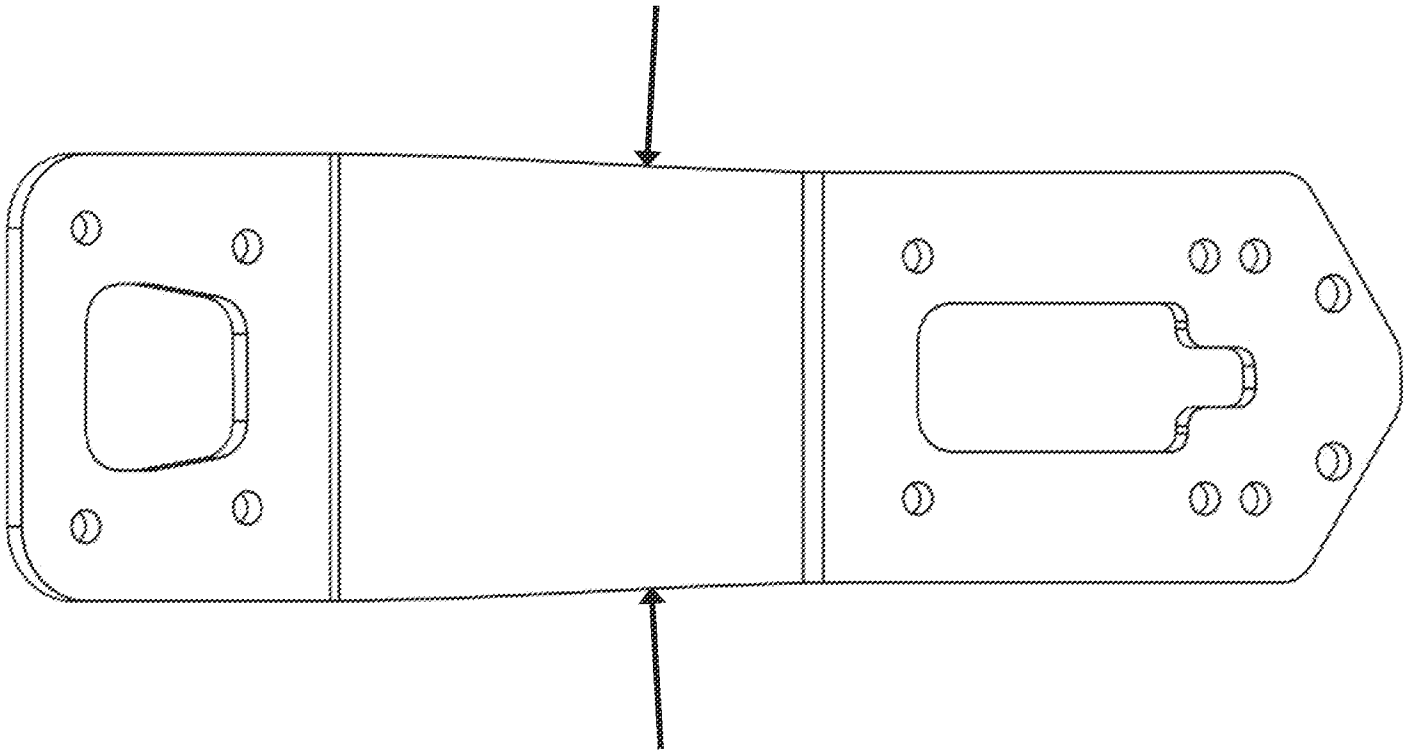
FIG. 5 is a top view of the suspension member of FIG. 3.

The suspension member additionally is configured to twist along its longest length. FIG. 6 representatively illustrates this by the lowermost curved arrows (proximate the third portion) and the uppermost curved arrow (proximate the first portion). In implementations the first portion and the third portion, in a resting state, are such that their largest flat planar surfaces are parallel or within fifteen (in some implementations within ten or within five) degrees of being parallel. When the suspension member twists, however, these largest flat planar surfaces are no longer parallel or no longer within fifteen degrees of being parallel (they are, of course, also not parallel or not within fifteen degrees of being parallel when the largest angles, described above, are increased or decreased beyond the resting state configuration in response to a downward or upward force, respectively). FIG. 5 has arrows pointing to the sides of the second portion to indicate that, in implementations, although not shown in the drawings, the second portion could be tapered inwards along its sides, being narrower towards a middle of the second portion and wider near its ends (at its junctures with the first and third portions). Such a tapered or narrowed configuration could, in implementations, further facilitate twisting of the suspension member along its longest length.

The twisting of the suspension member may occur in response to the user providing a toeside downward force or a heelside downward force. This could occur, for example, during a turning maneuver or during a pumping action. A pumping action may be achieved by the user intentionally alternating between a toeside downward force and a heelside downward force in a manner that the suspension members twist and assist to propel the skateboard forward. The toeside and heelside downward forces may be provided by the user leaning toeside to heelside and back, and so forth. The assistance for pumping may be provided not only from the twisting of the suspension member, but also from the compression and release associated with the rider's movements. For example, there may be a spring-loaded response to each toeside/heelside movement (for example a toeside movement rebounding toward a heelside movement and vice-versa) and/or from every downward compression/release that helps to increase speed (or rebound) while pumping.

Figure 7:
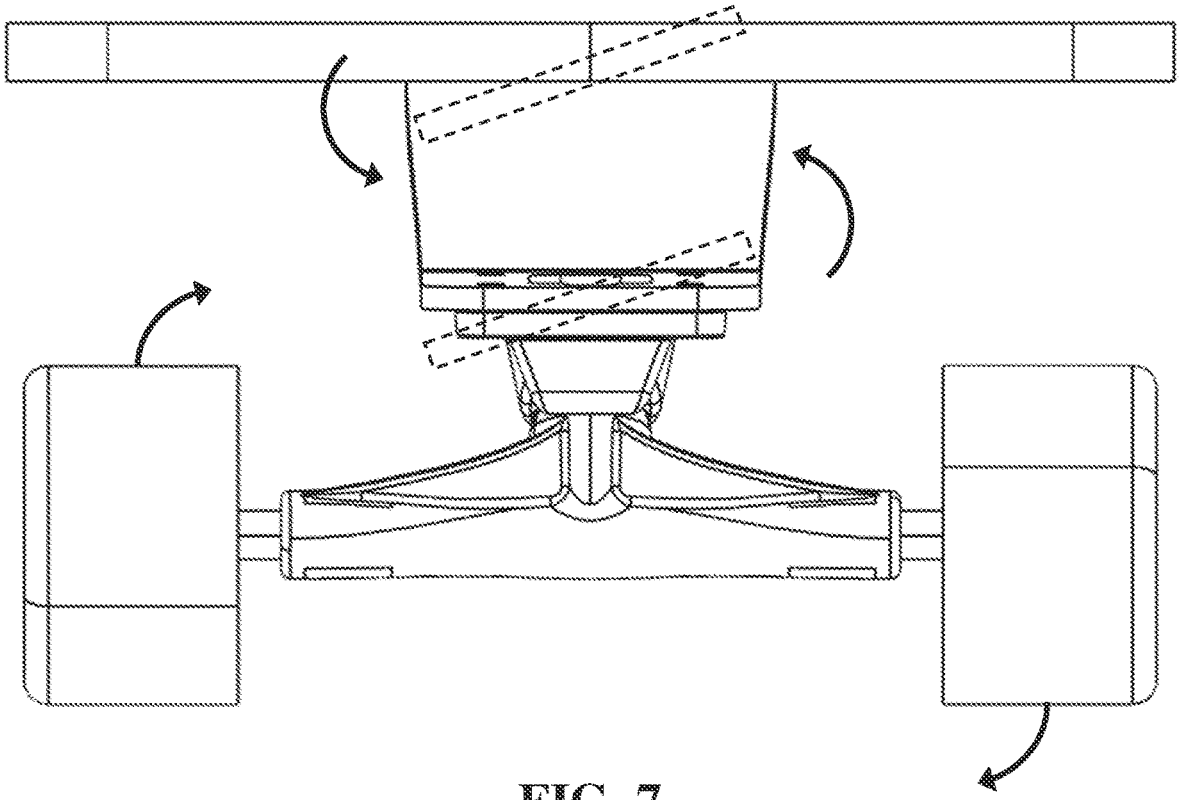
FIG. 7 is a rear view of the system of FIG. 1.

The twisting of the suspension member is also representatively illustrated in FIG. 7, which shows that, in response to a downward force on the left side of the deck (for example a toeside force), the first portion and third portion will both rotate counter-clockwise (represented by the dashed outlines and the proximate curved arrows). They may not rotate the same amounts, however, due to the twisting mechanism, and the twisting and/or rotating further affects the wheels as well, with the axle rotating clockwise (from a perspective looking downward from above the deck, represented by the curved arrows proximate the wheels). This allows for a tighter turn to be made by the skateboard.

Figure 8:
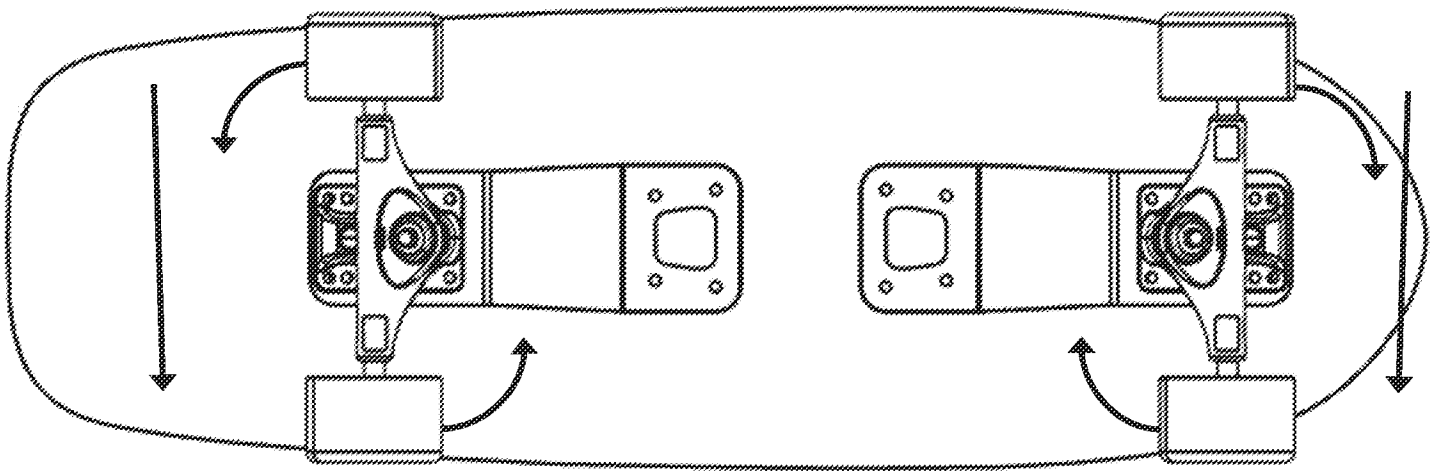
FIG. 8 is a bottom view of the system of FIG. 1.

The tighter turn is facilitated by both suspension members, as representatively illustrated in FIG. 8. In response to the toeside force (representatively illustrated by the leftmost and rightmost straight arrows), the tail-side axle rotates counter-clockwise and the nose-side axle rotates clockwise (both from the perspective looking into the page). These rotations are at least in part facilitated by the rotation and/or movement of the suspension members, and the rotations allow the skateboard to make tighter turns than would be capable without the suspension members.

Figure 9:
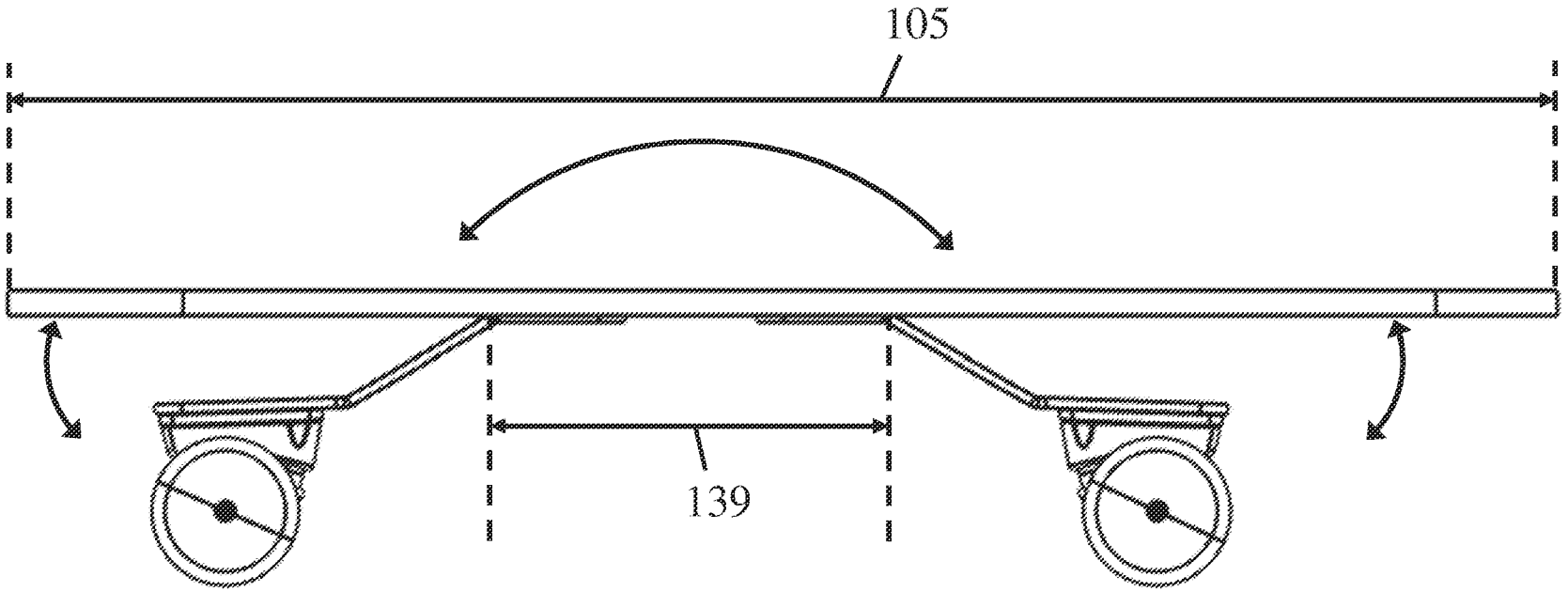
FIG. 9 is a side view of the system of FIG. 1.

FIG. 9 further illustrates that the mounting locations of the suspension members towards the center of the deck (and closer to the center than conventional truck mounting locations) allows for the deck itself to flex in a downward curve, with both the tail and nose side curving downward. This is represented by the three curved arrows in FIG. 9. It is also seen in FIG. 9 that a distance 139 between the mounting locations of the suspension members has a length that is less than one-third of a longest length 105 of the deck. In implementations the distance could have a greater length, such as half, or less than half, of the longest length of the deck. This contrasts with a conventional truck assembly configuration where the truck assemblies are mounted to the deck at the conventional truck mounting holes. In such a configuration the distance between the mounting locations of the truck assemblies is generally greater than half, and in some cases greater than two thirds or three fourths, the longest length of the deck. The difference in the mounting locations provides for different suspension characteristics of the skateboard systems disclosed herein by allowing the deck to flex differently or in different locations (in addition to the different suspension characteristics provided by the bending and twisting of the suspension members themselves). In other implementations the suspension members could be mounted at the ends of a skateboard or longboard deck (for instance, mounted on or proximate the tail and/or nose of the skateboard deck), which may provide different flexing characteristics (for example allowing the center of the deck to bow downward towards the ground while the nose and tail angle upward away from the ground in response to a downward force proximate a horizontal center of the deck (i.e., located horizontally between the nose and tail of the deck), and a reverse rebounding flexion in response to a rebounding upward force proximate the center of the deck.

Figure 10:
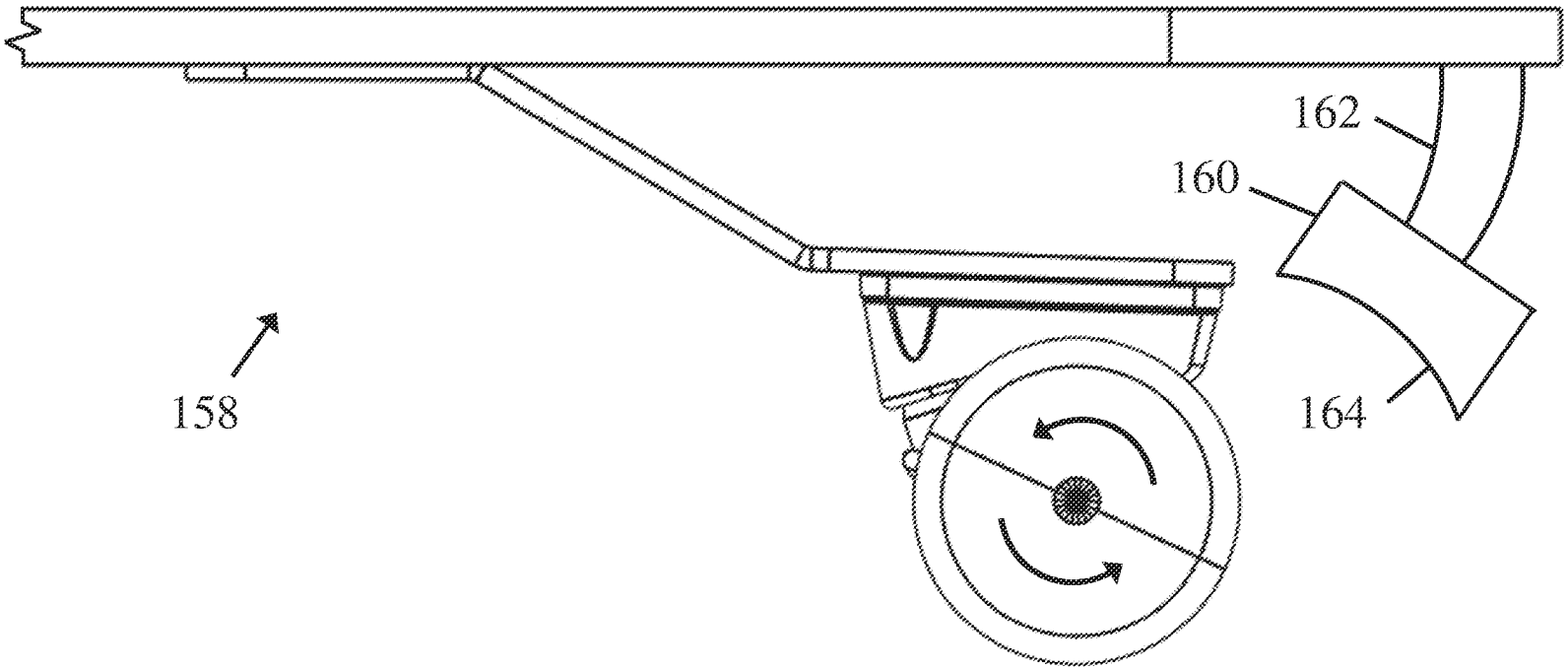
FIG. 10 is a partial side view of another implementation of a skateboard system.
Figure 11:
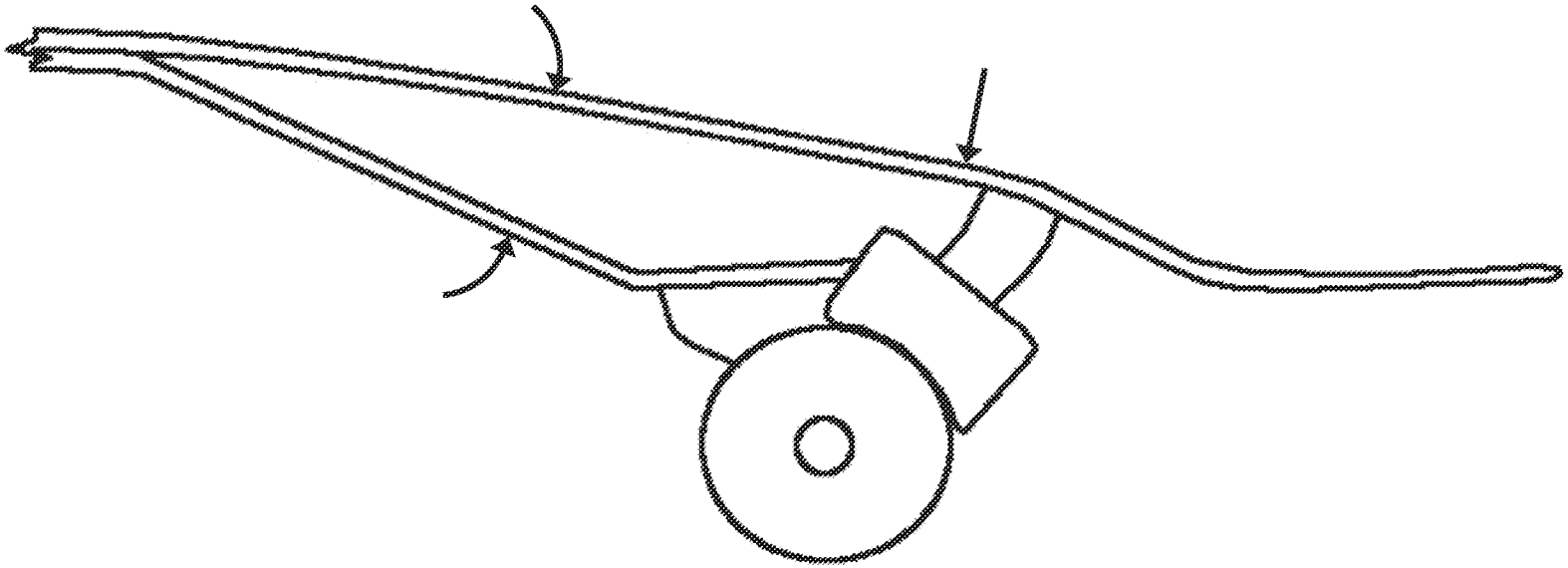
FIG. 11 is a partial side view of the system of FIG. 9 in a compressed configuration.

FIG. 10 shows a partial side view of another skateboard system 158, which is qualitatively similar to system 102 but further includes a brake member 160. The brake member in this implementation includes a brake pad 164 coupled to an underside of the deck using an arm 162. The brake pad in this case has a curvature configured to provide for more surface area contact with the riding surface of the wheel when the brake pad comes in contact with the wheel. FIG. 11 shows system 158 in a compressed configuration provided by a downward force on the tail of the deck (in FIG. 11 the deck is illustrated with a kicktail, as opposed to the deck in FIG. 10, only to illustrate that any of the skateboard systems may or may not include a kicktail). The downward force at the tail or near the tail is representatively illustrated by the rightmost arrow. In response to this downward force the deck flexes downward and the suspension member flexes upward, represented by the two curved arrows. As this occurs, the brake pad is brought proximate with, and eventually contacts, the wheel. This allows the user to provide a braking of the skateboard with a downward force on a tail of the deck.

Figure 12:
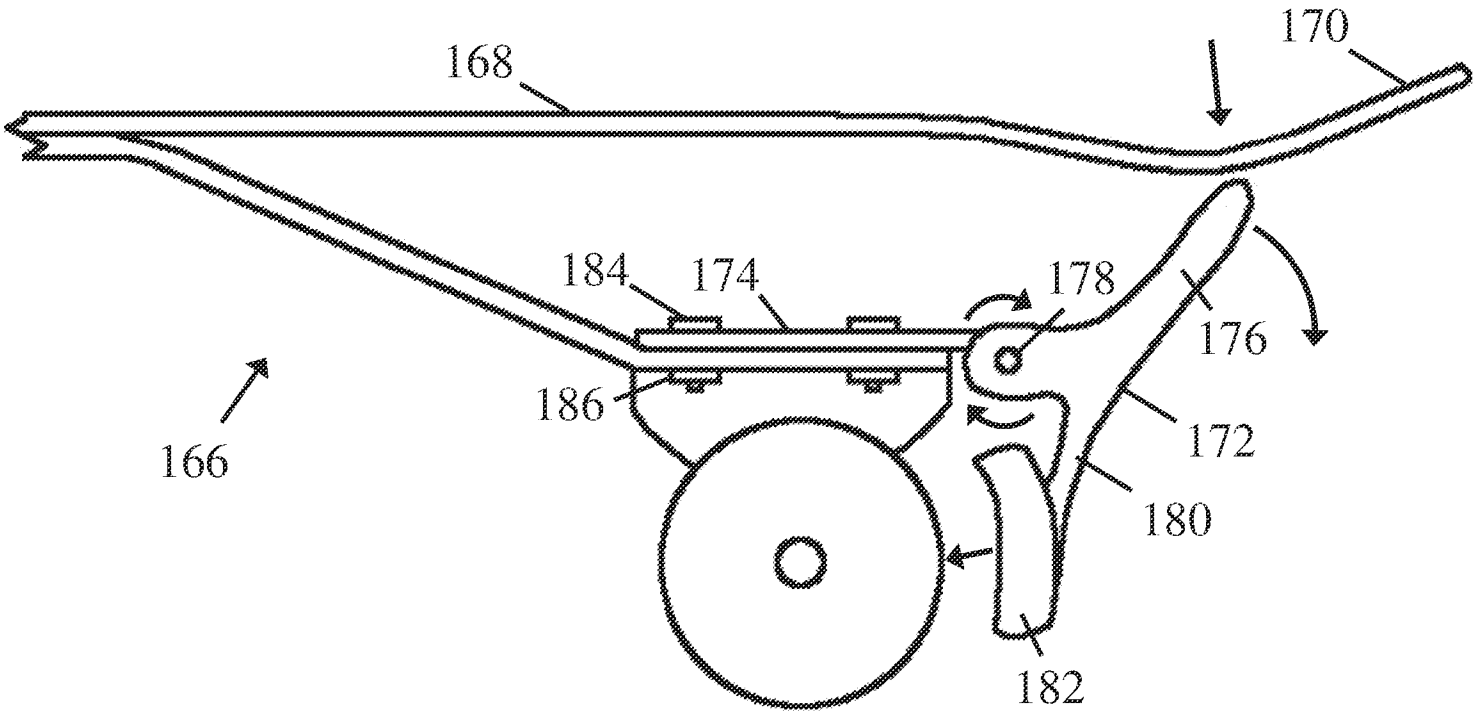
FIG. 12 is a partial side view of another implementation of a skateboard system.
Figure 13:
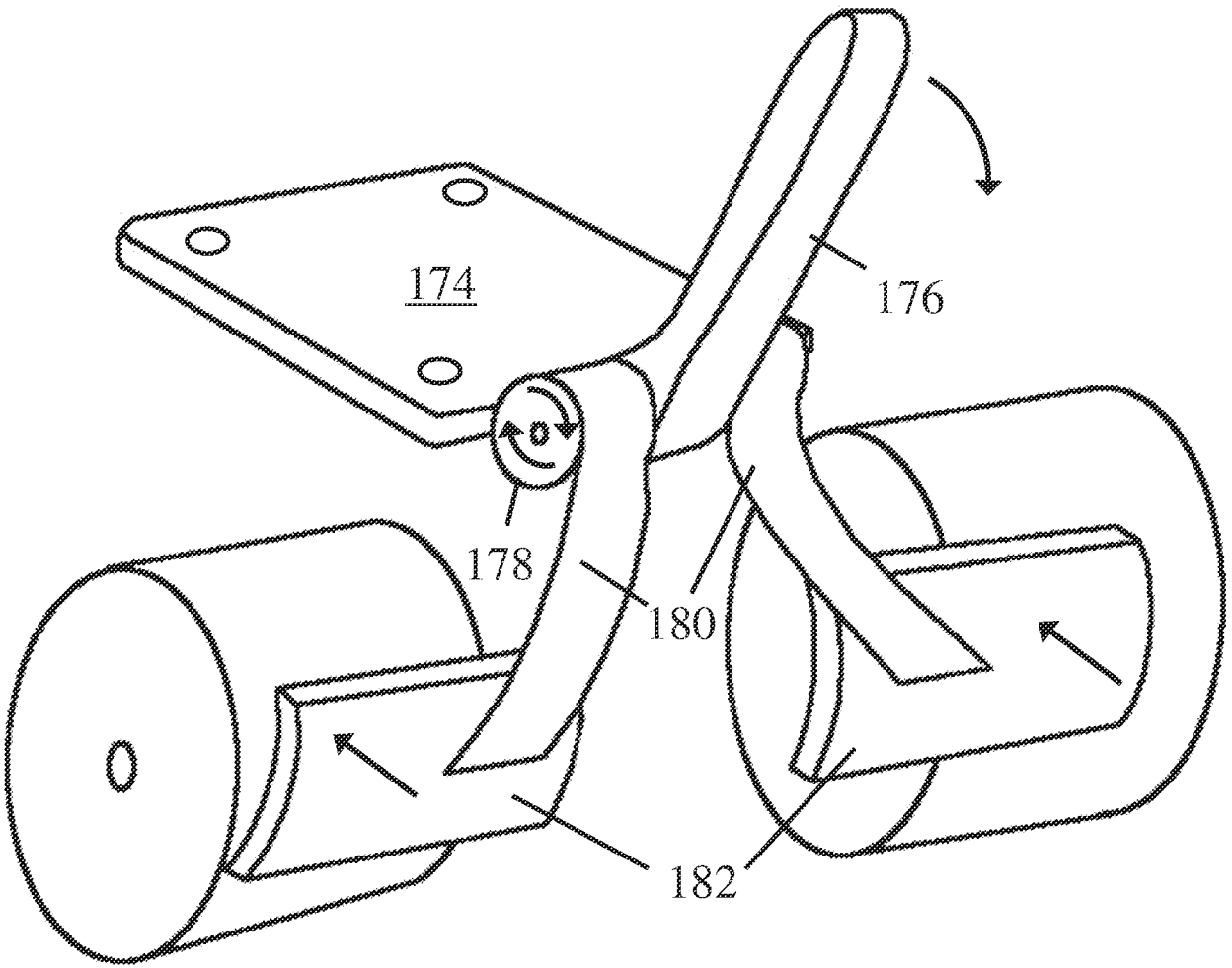
FIG. 13 is a rear perspective view of elements of the system of FIG. 12.

FIGS. 12 and 13 representatively illustrate another skateboard system 166 that includes a deck 168 having a kicktail 170. A brake member 172 is included, though this brake member has a mounting plate 174 that couples to a topside of the third portion of the suspension member using mounting holes of the mounting plate that align with mounting holes of the third portion (while the truck assembly couples to the underside of the third portion using the same mounting holes of the third portion). The mounting holes of the mounting plate are visible in FIG. 13. Bolts 184 and nuts 186 are used to couple the mounting plate and truck assembly (shown in see-through in FIG. 12) to the third portion. Alternatively, in some cases the mounting plate could be coupled to the third portion using mounting holes of the third portion that are not needed for coupling the third portion with the truck assembly. In either case, the brake member includes an activation lever 176 and two brake levers 180 that rotate about a horizontal pivot 178 (which may be an axle or hinge member) in response to a downward force (represented by the downward arrow near the kicktail in FIG. 12). The clockwise rotation at the pivot is represented by the curved arrows proximate the pivot in both FIGS. 12 and 13. The rotation of the activation lever in response to the downward force is represented by the curved arrow proximate the activation lever in both FIGS. 12 and 13. The brake pads 182 move towards the wheel in response to the rotation of the brake member, represented by the arrows proximate the brake pads in both FIGS. 12 and 13. With sufficient downward force on the deck the brake pads contact the riding surfaces of the wheels to provide braking. A spring or other biasing member may be included to bias the brake pads away from the wheels, so that the brake pads are not engaged until sufficient downward force at the tail is provided to overcome the bias.

Figure 14:
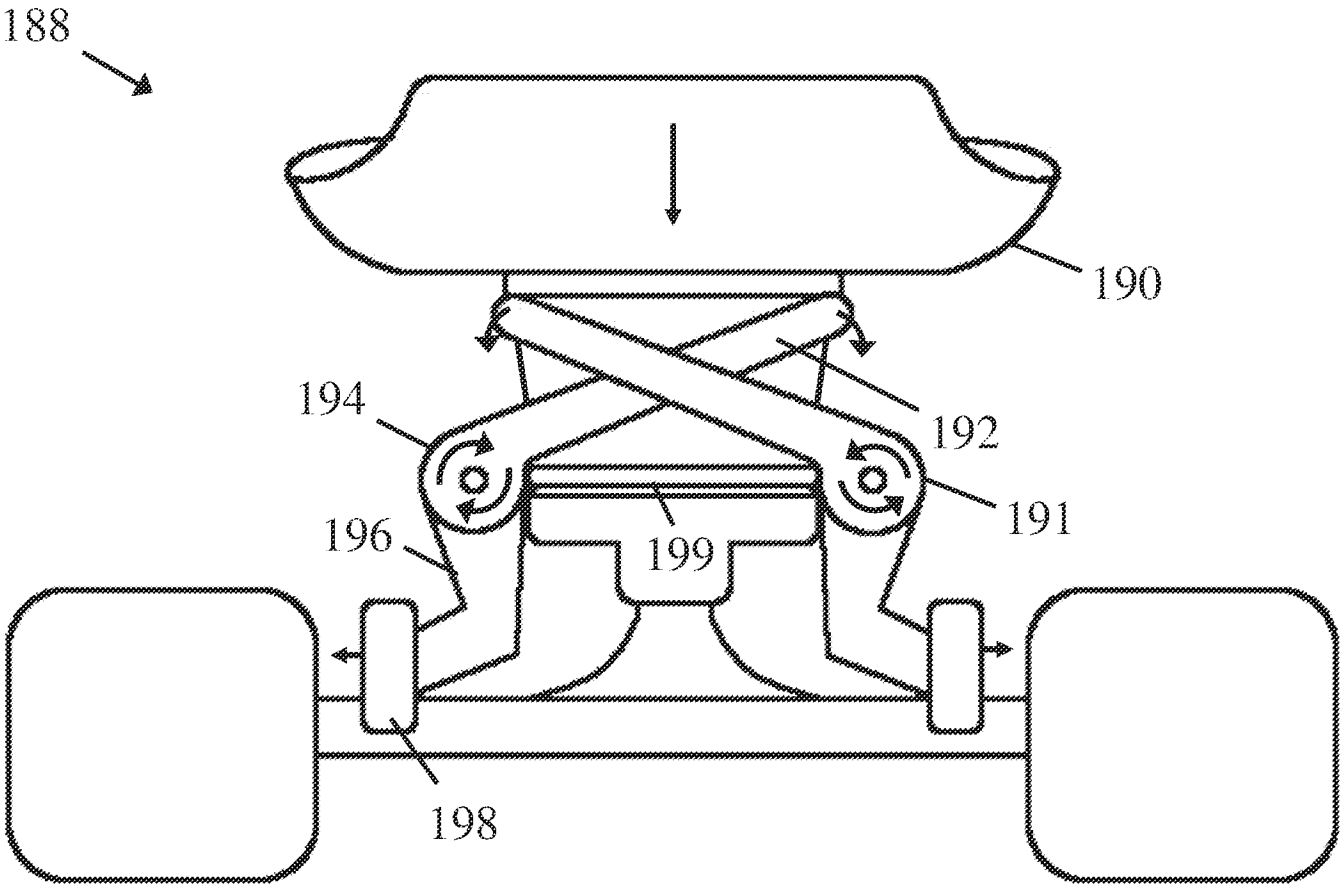
FIG. 14 is a rear view of another implementation of a skateboard system.
Figure 15:
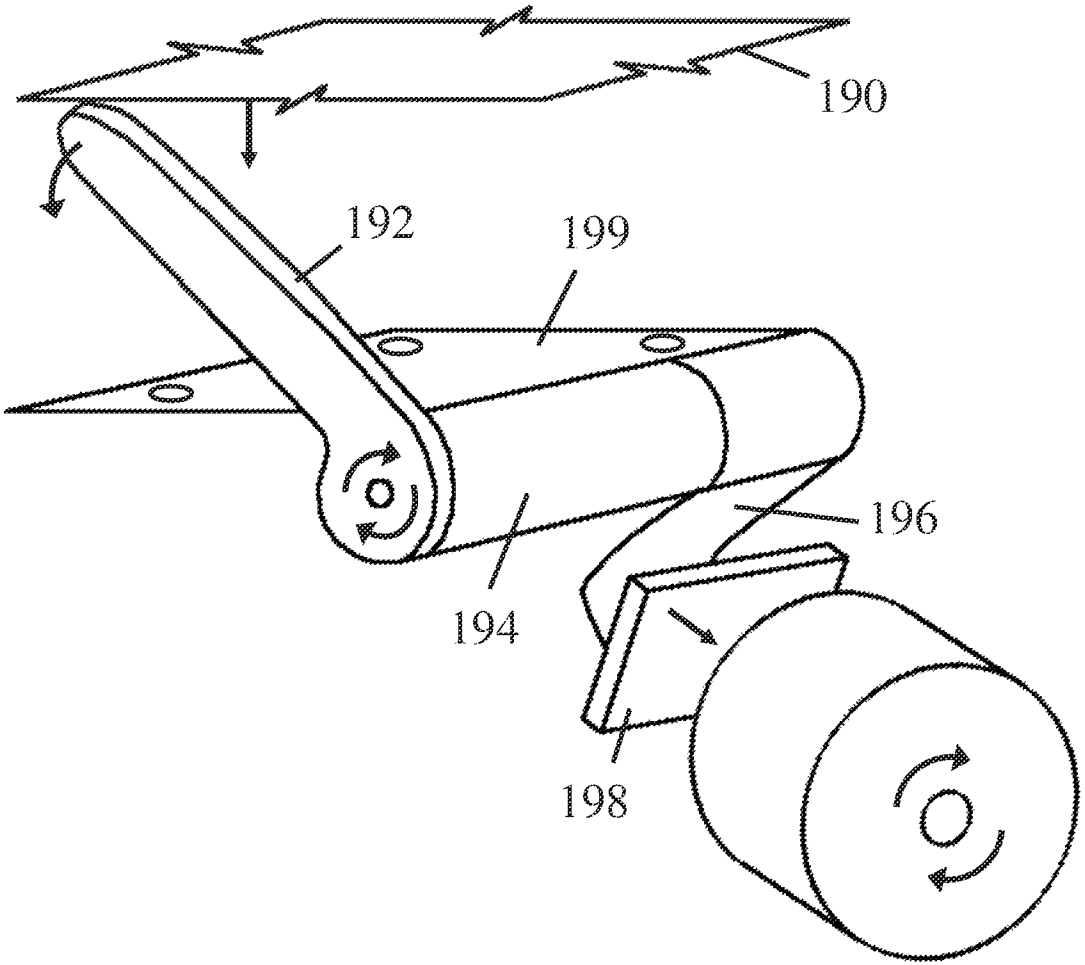
FIG. 15 is a rear perspective view of elements of the system of FIG. 14.

FIGS. 14-15 illustrate another skateboard system 188 which includes a deck 190. Brake member 191 is included which includes two activation levers 192, two horizontal pivots 194, two brake levers 196 and two brake pads 198. A mounting plate 199 is also included to mount the brake system to the third portion of the suspension member (the third portion of which can be seen sandwiched between the mounting plate and the truck assembly). A plate contacts the tops of the activation levers and is located below the deck (it is not called out by number), but in implementations this could be excluded and the deck itself could directly contact the activation levers (either always or only during sufficient downward force). In response to downward force at the deck (represented by the downward arrow at the deck), the activation levers rotate (represented by the curved arrows proximate the activation levers) about the horizontal pivots (which rotation about the pivots is represented by the curved arrows proximate the pivots) and the brake pads 198 are moved towards the inner sidewalls of the wheels (represented by the arrows proximate the brake pads). With enough downward force on the deck the brake pads contact the inner sidewalls to provide braking.

FIG. 15 shows elements of the brake member 191 and deck 190, but from a different angle. The downward force of the deck is represented by the downward arrow proximate the deck, the rotation of the activation lever 192 is represented by the curved arrow proximate a top of the activation lever, the rotation at the pivot 194 is represented by the curved arrows proximate the pivot, and the brake lever 196 rotates to move the brake pad 198 towards the inner sidewall of the wheel (the motion of the brake pad represented by the arrow proximate the brake pad). The wheel rotates (represented by the curved arrows proximate the wheel) but the rotation is slowed and/or stopped when the brake pad engages the inner sidewall of the wheel. The mount holes of the mounting plate 199 are seen in FIG. 15. For ease of viewing the elements, only one activation lever, brake lever, wheel, etc. is shown in FIG. 15. As with other brake members, brake member 191 may be biased with a spring or the like so that that brake pads are biased away from the wheels until sufficient downward force is applied at the deck.

Figure 16:
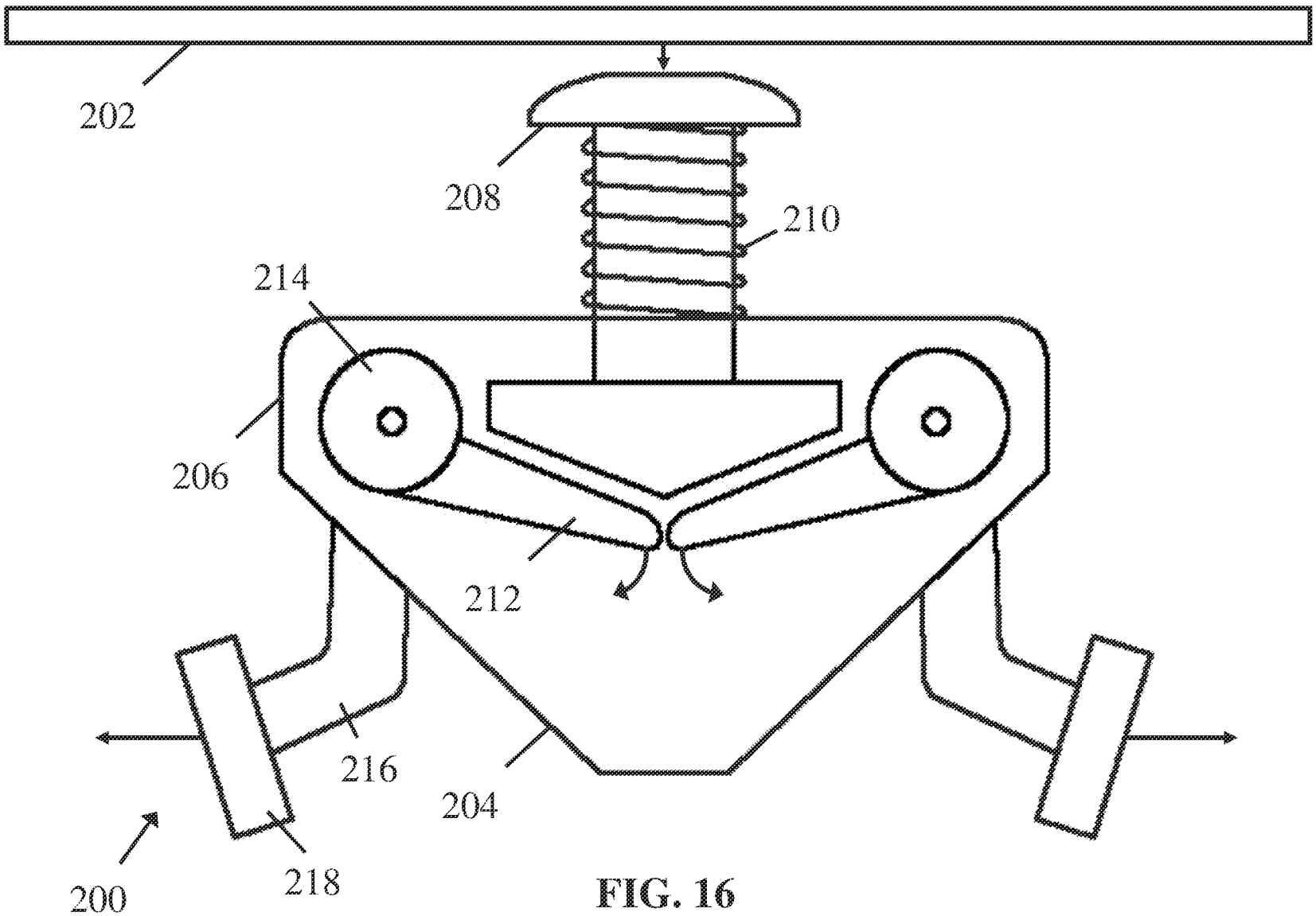
FIG. 16 is a rear view of elements of another implementation of a skateboard system.

FIG. 16 illustrates elements of another skateboard system 200 which includes a deck 202 and a brake member 204. The brake member includes a housing 206 which at least partially houses the activation levers 212. When downward force is provided on the deck (represented by the downward arrow proximate the deck) an activation pin 208 (which is biased upward using spring 210) is pressed downward to rotate the activation levers (represented by the curved arrows proximate the activation levers) about the horizontal pivots 214 (which again may be axles or hinges, as with other horizontal pivots discussed herein). In response, the brake levers 216 rotate so that the brake pads 218 are moved outwards to contact the inner sidewalls of the wheels to provide braking. Brake member 204 may include a mounting plate, as with other brake members, but it is not shown in FIG. 16 for ease of viewing the other elements. When sufficient downward force is provided at the deck, the bias of the spring (which biases the brake pads away from the wheels) may be overcome to depress the pin, rotate the activation and brake levers about the pivots, and apply the brake pads to the inner sidewalls of the wheels for braking.

Figure 17:
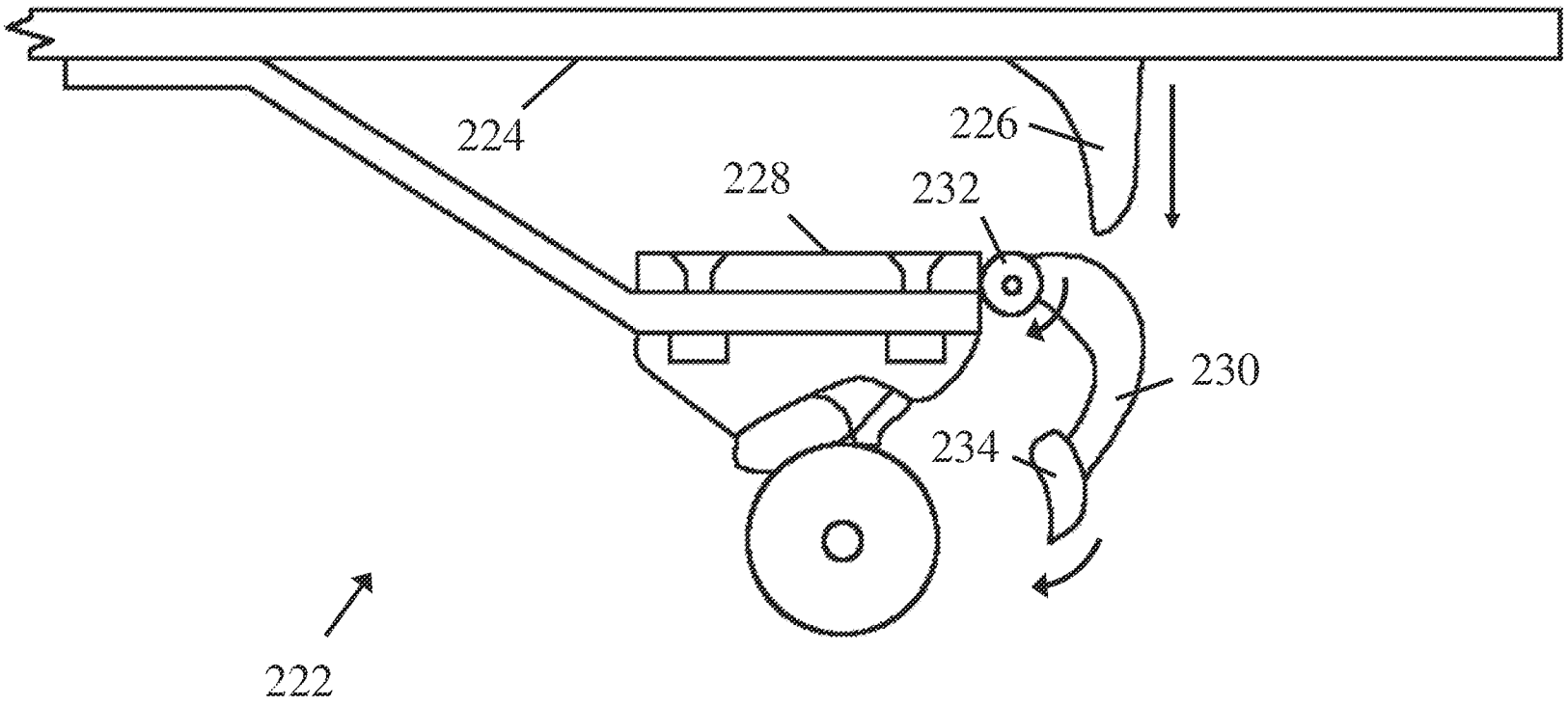
FIG. 17 is a partial side view of another implementation of a skateboard system.
Figure 18:
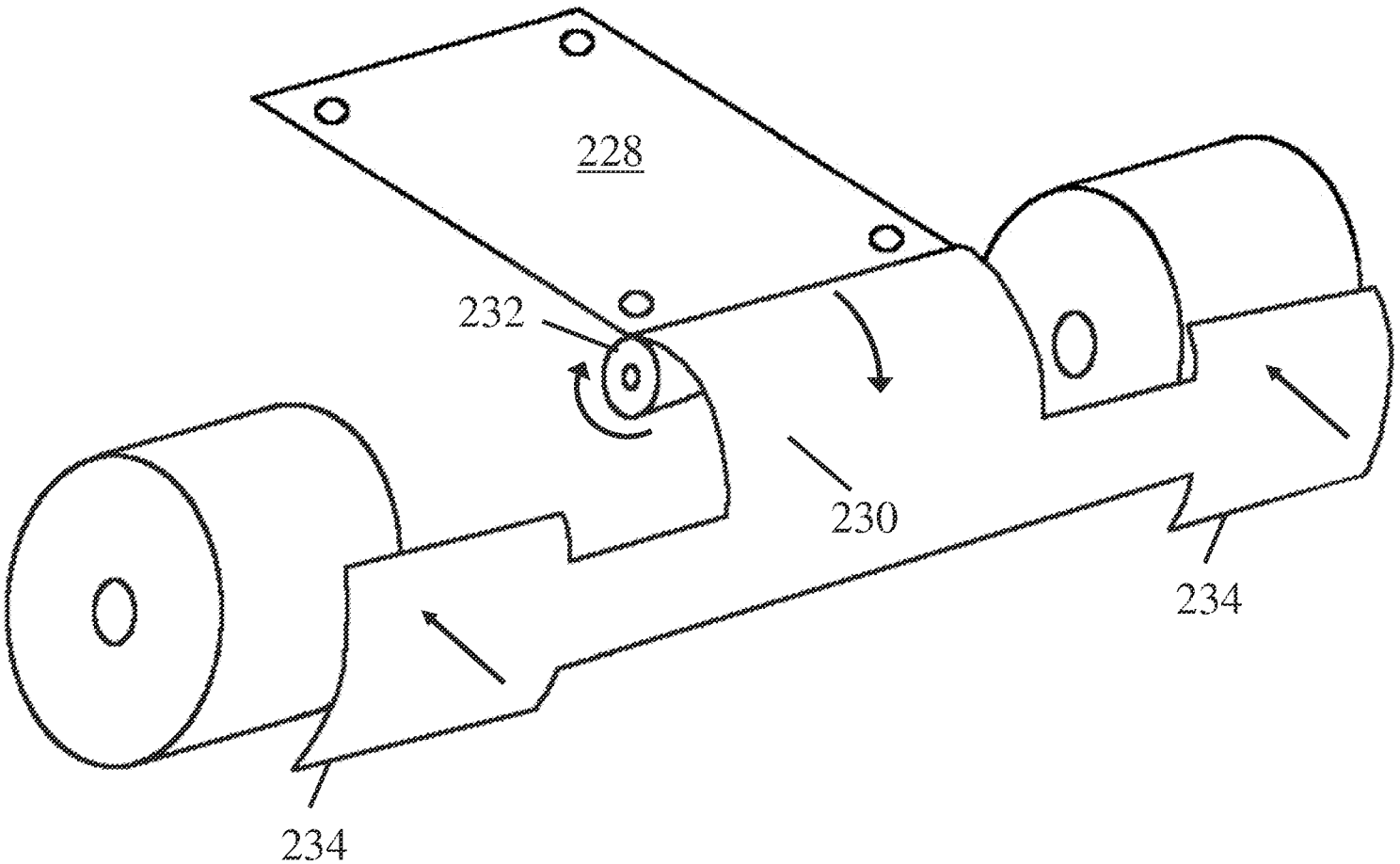
FIG. 18 is a rear perspective view of elements of the system of FIG. 17.

FIGS. 17 and 18 show another skateboard system 222 which includes a deck 224 that has a brake activation member 226. The brake activation member could be a fin-like element, a shaft, etc., and the shape shown in FIG. 17 is only one example. A mounting plate 228 (shown in see through) in FIG. 17 is mounted to the third portion of the suspension member, along with a truck assembly. A brake lever 230 rotates about a horizontal pivot 232 to cause brake pads 234 to contact the riding surfaces of the wheels to provide braking. The brake lever may be biased using a spring or the like so that the brake pads do not contact the wheels until sufficient downward force is applied at the deck. When sufficient downward force is applied, represented by the downward arrow proximate the brake activation member, the brake activation member contacts the brake lever to rotate it about the pivot, which again may be an axle or hinge—the rotation represented by the curved arrow proximate the pivot in FIG. 17, the curved arrow proximate the pivot in FIG. 18, and the curved arrow proximate the brake lever 230 in FIG. 18. This rotates the brake pads towards the wheels, represented by the curved arrow proximate the brake pad in FIG. 17 and the straight arrows proximate the brake pads 234 in FIG. 18. With sufficient downward force at the deck, the brake pads contact the wheels to provide braking.

Figure 19:
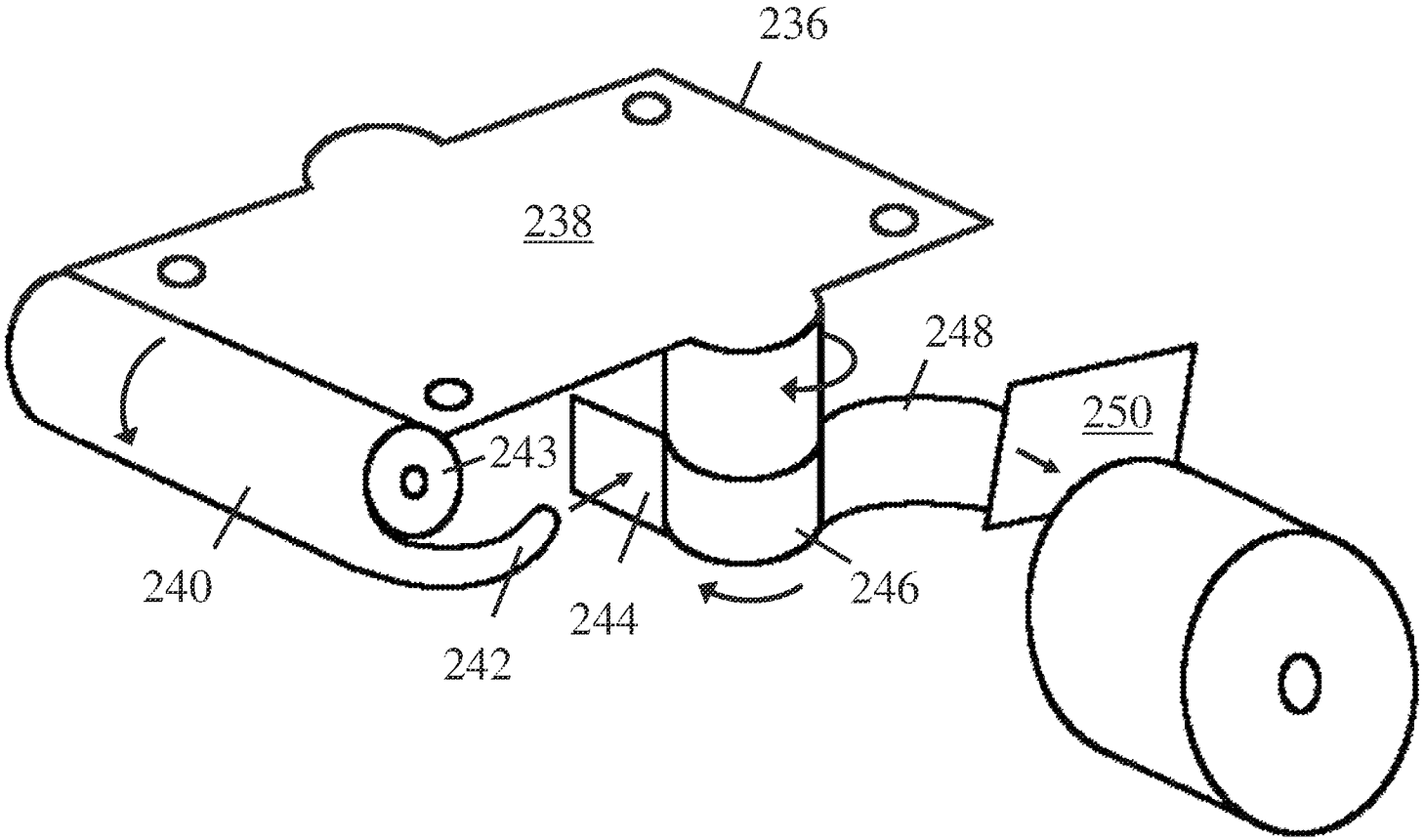
FIG. 19 is a rear perspective view of elements of another implementation of a skateboard system.
Figure 20:
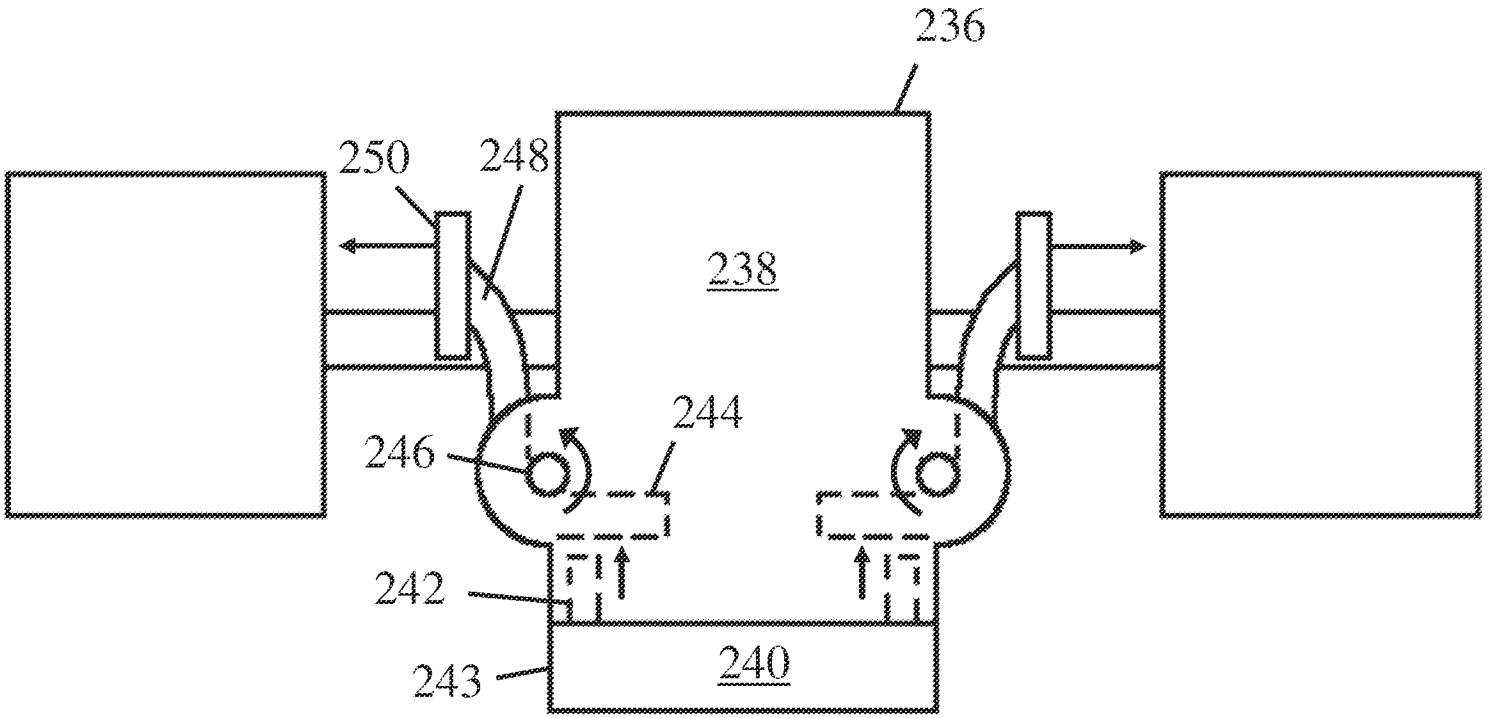
FIG. 20 is a top partial see-through view of elements of the system of FIG. 19.
Figure 21:
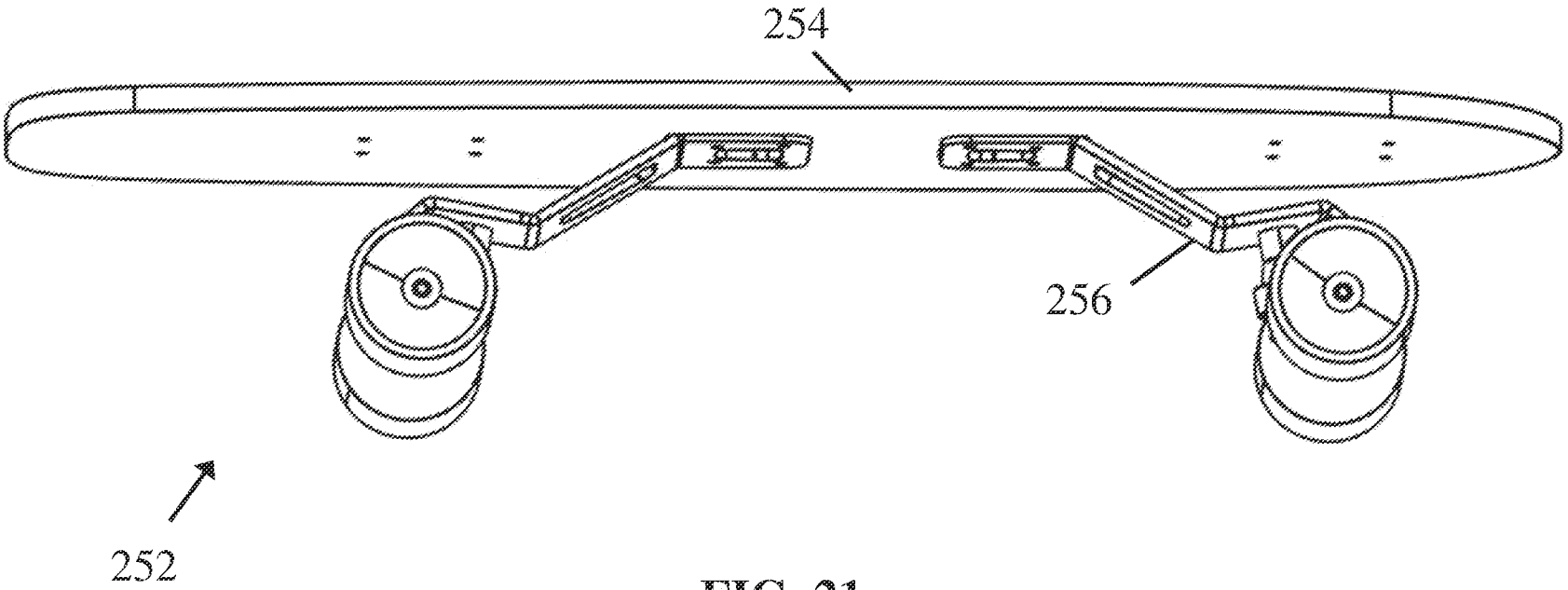
FIG. 21 is a side perspective view of another implementation of a skateboard system.

FIGS. 19 and 20 show a brake member 236 which includes a mounting plate 238 with mounting holes to be coupled with the third portion of a suspension member (the mounting holes are not shown in FIG. 20 for ease of viewing the other elements). As with other brake members, this brake member may be biased to the disengaged position using a spring or the like. This brake member could be used with the deck 224 and brake activation member 226 of FIG. 17. With sufficient downward force at the deck, the brake activation member contacts and rotates the first activation lever 240 about horizontal pivot 243, which may be an axle or hinge, and which rotation is represented by the curved arrow proximate the first activation lever in FIG. 19. In response to this rotation, push members 242 (one of which is shown in FIG. 19 and both of which are shown in dashed outline in FIG. 20) move towards and eventually contact second activation levers 244, which motion is represented by a straight arrow proximate the shown push member in FIG. 19 and straight arrows proximate the push members in FIG. 20. One second activation lever 244 is seen in FIG. 19 and both second activation levers are seen in dashed outline in FIG. 20. In response to the push members pushing the second activation levers, the second activation levers and the brake levers 248 rotate about the vertical pivots 246, which rotation is represented by the curved arrows proximate the pivots in FIGS. 19 and 20 (the vertical pivots may be hinges or axles). The brake pads 250 are then pushed towards the inner sidewalls of the wheels, represented by the straight arrows proximate the brake pads. With sufficient downward force at the deck, the brake pads contact the inner sidewalls of the wheels and provide braking of the skateboard.

FIGS. 21-25 show another skateboard system 252, which includes a deck 254 having the same features as deck 104 and suspension members 256 which are in some ways similar to suspension members 116.

Figure 22:
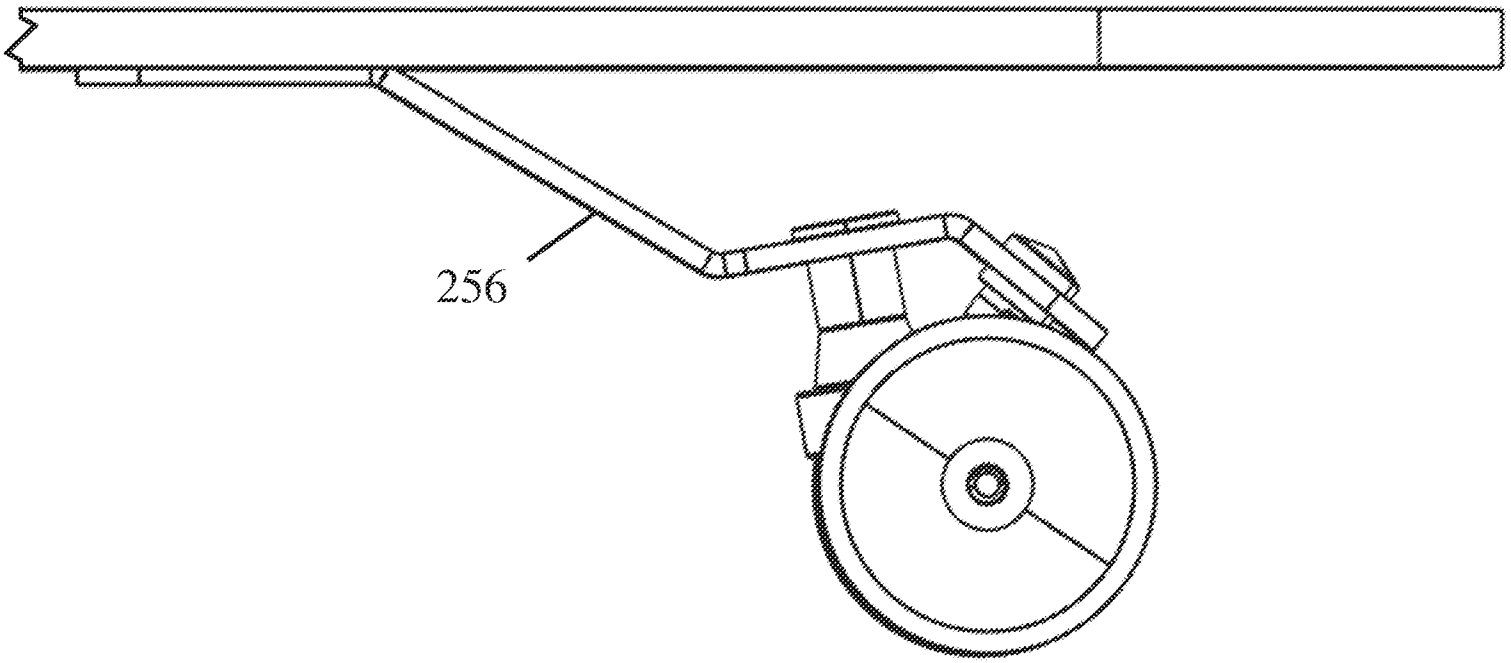
FIG. 22 is a partial side view of the system of FIG. 21.

In FIG. 22 it is seen that the suspension member has four portions and, going in a direction from the first portion (mounted to the deck) to the fourth portion, the first portion is flush with the deck in the installed configuration, the second portion is angled downward away from the deck, the third portion is angled upward toward the deck, and the fourth portion is angled downward away from the deck.

Figure 23:
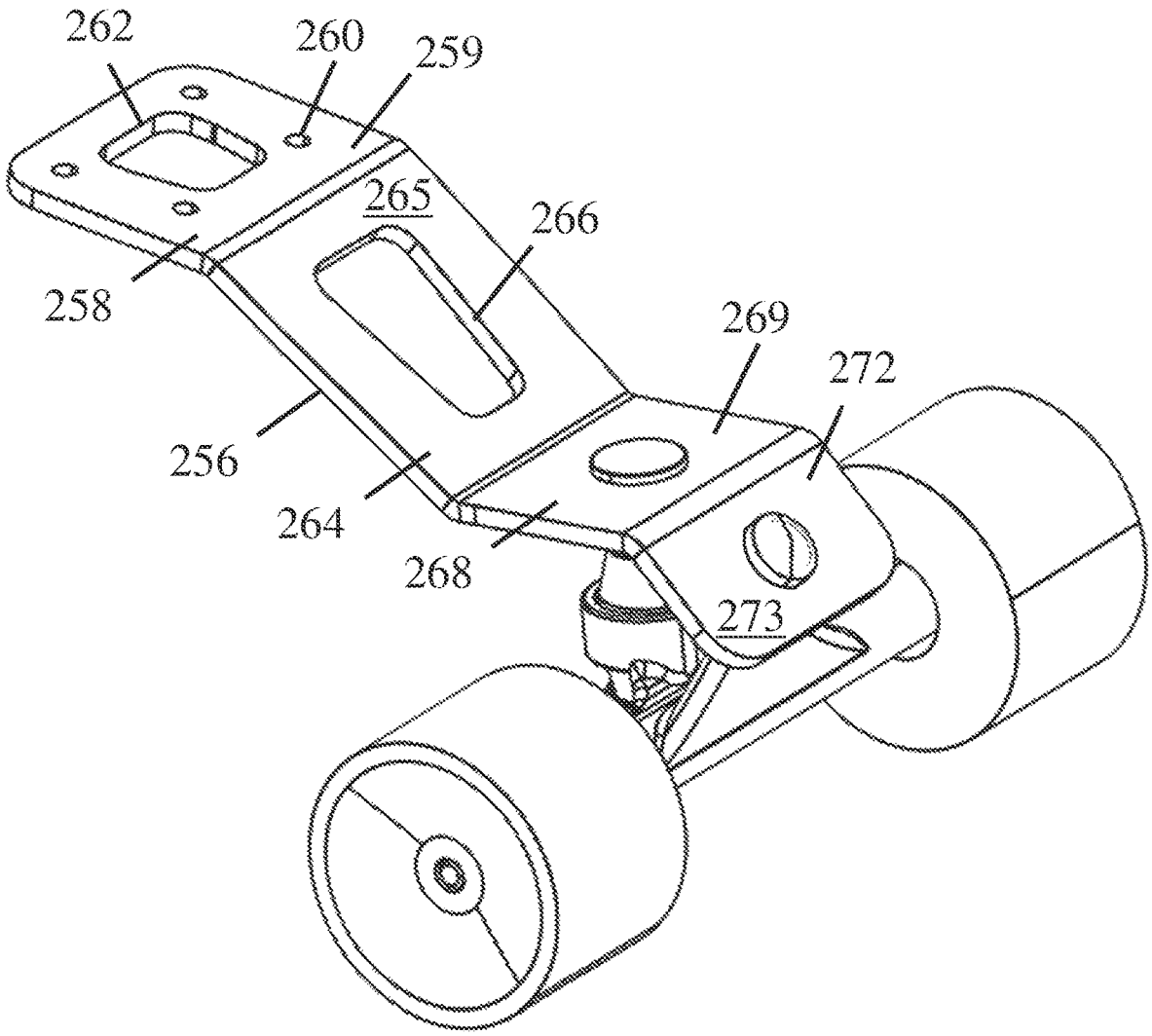
FIG. 23 is a side perspective view of elements of the system of FIG. 21.
Figure 24:
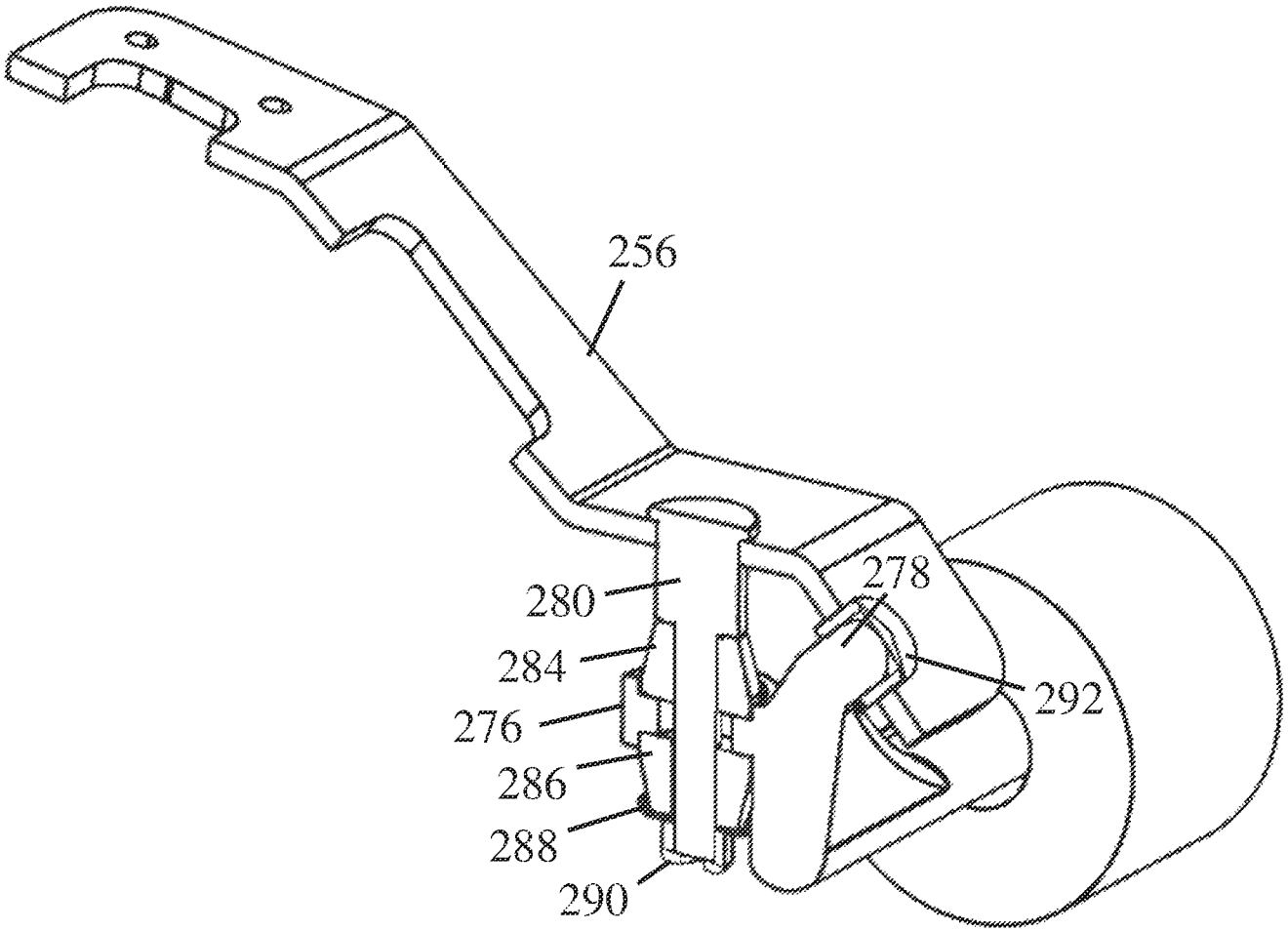
FIG. 24 is a side perspective cross-section view of elements of the system of FIG. 21.
Figure 25:
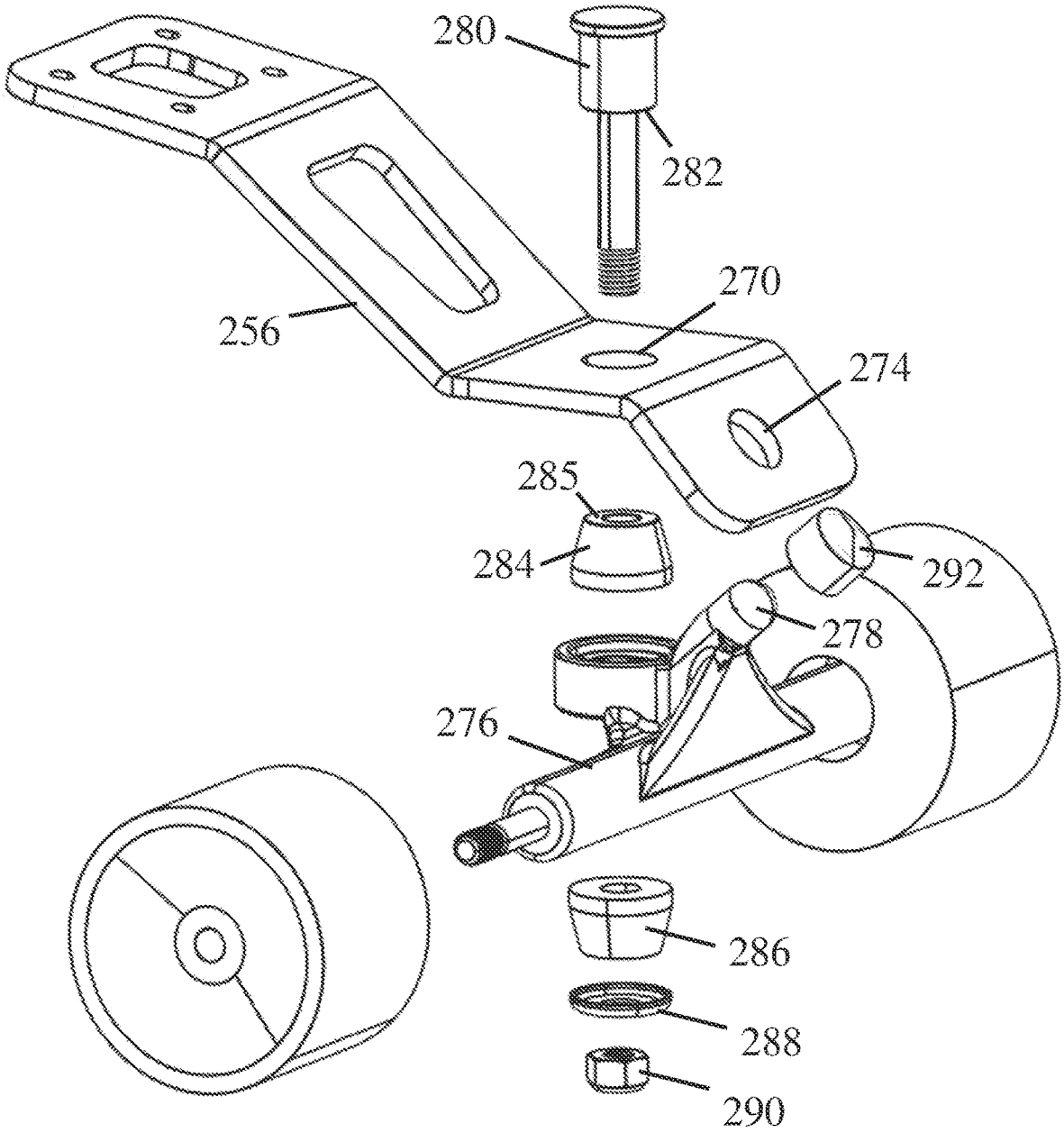
FIG. 25 is a side perspective exploded view of elements of the system of FIG. 21.

FIG. 23-25 show that the suspension member includes a first portion 258 having a largest flat planar surface 259, mount holes 260 and an opening 262, and a second portion 264 having a largest flat planar flat surface 265. These elements may have the same characteristics, functions, and qualities as those described above for other suspension members. The second portion includes an opening 266 which may reduce weight and material cost of the suspension member but, also, may allow the suspension member to more easily twist along its longest length, at least partly by making it less rigid. The third portion 268 has a largest flat planar surface 269 and includes only a single opening 270. A fourth portion 272 has a largest flat planar surface 273 and in FIG. 25 is seen to have an opening 274 for receiving a pivot cup 292. In implementations the pivot cup may be situated within the opening in a non-fixed manner, such that it can slide and rotate therein. In other implementations the pivot cup may be fixedly attached with the opening, such that it is not movable. In some implementations the suspension member could be molded, cast or formed with the pivot cup integral thereto so that there is no opening 274.

Suspension member 256 provides the same suspension characteristics, twisting, and so forth as other suspension members described above. However, suspension member 256 is configured to allow a skateboard hanger 276 to couple with the suspension member without a full truck assembly (for example, a truck baseplate is not needed). A kingpin bolt 280 couples with the suspension member through opening 270 and also passes through aligned openings in a first bushing 284, the hanger, a second bushing 286, a retainer 288 (which may be a washer), and a kingpin nut 290. The kingpin bolt has a stepped configuration, forming a flat surface 282, which is configured to mate with a flat surface 285 atop the first bushing. In other implementations surface 282 may not be a flat surface but may be a sloped or cupped surface (similar to the surface of some washers and/or similar to the upper or lower surface of retainer 288) to best hold the bushing in place. In implementations surface 285 may not be a flat surface but may have a non-flat configuration. In implementations, however, the surfaces 285 and 282 are each substantially flat. The kingpin bolt and nut may be tightened or loosened as desired to compress the bushings more or less and to provide greater or less movement of the hanger relative to the suspension member. The hanger includes a pivot member 278 that is situated in the pivot cup in an installed configuration. The pivot member is allowed to rotate and move within the pivot cup. The pivot cup stabilizes the hanger while allowing the hanger to rotate and pivot (for example allowing for wheel rotations previously described, allowing for the deck to rotate towards the toe or heel side relative to the hanger/wheels, and so forth.

In implementations the kingpin bolt may be press-fit in the opening 270 or welded to the third portion. In implementations the kingpin bolt could be forged/cast together with the suspension member so that the opening 270 is excluded altogether.

The kingpin bolt is threaded as to be able to be secured to the kingpin nut and, when adjusted, will compress both the first bushing and second bushing in order to adjust the turning radius of the hanger/axle. The opening 274 and pivot cup allow the pivot member 278 to penetrate through the fourth portion into the pivot cup. Retaining the pivot member therein, but allowing it rotation and movement therein, allows the hanger axle to pivot in a controlled manner.

The suspension members disclosed herein may be formed of various materials, such as metals, carbon fiber composites and other composites (using a variety of reinforcing particles/fibers/layers and a variety of matrix materials), rigid/strong polymers, and so forth. In implementations they are each formed of a single flat piece of metal that has bends and multiple openings. The bends and openings may be formed through plastic deformation, punching, drilling, laser cutting, waterjet cutting, and other material deformation and/or material removal techniques, after the flat piece of metal is forged/cast, or the bends and/or openings could be originally cast/forged in the single piece of metal. In implementations one or more heat treatments (such as one or more cycles of heating up to or above 1600 degrees Fahrenheit and/or tempering) or other manufacturing or metallurgical methods may configure the suspension members to have a Rockwell hardness between 35 and 55, inclusive, for appropriate spring and flexion characteristics. In implementations the suspension members are configured to have a Rockwell hardness between 42 and 48, inclusive. In implementations the suspension members are configured to have a Rockwell hardness between 43 and 47, inclusive.

In implementations the suspension members are formed of steel, such as carbon steel or spring steel. By non-limiting examples, in implementations the suspension members could be formed of AISI 1050 spring steel, AISI 1075 spring steel, AISI 1095 spring steel, or another spring steel—though in other implementations they could be made of non-steel metals in some instances, or even semi-rigid polymers or composite materials in some implementations. In implementations the suspension member may have a thickness of 3/16 inch, or 1/8 inch, or another thickness (thicker or thinner). As non-limiting examples, in a resting configuration the suspension member 256 could in implementations have a largest angle between the first and second portions of 150 degrees, a largest angle between the second and third portions of 140 degrees, and a largest angle between the third portion and fourth portions of 131 degrees. As a non-limiting example, suspension member 256 in the installed configuration may have a total horizontal length of 8.41 inches, a total vertical length of 2.36 inches, and a total width (into the page) of 3.00 inches.

The decks may be made of any materials, for example woods, polymers, composites, and so forth. In implementations the decks may be formed of laminated layers of maple wood (for example an eight-ply maple laminate). In implementations the decks may be sold with custom bolt holes configured for the mounting of the suspension members. In other implementations the suspension members may be sold in a kit to be used on an existing deck which already has conventional truck mounting holes. In such cases the kit may include a drilling template for adding new holes in the deck to mount the suspension members.

In implementations a skateboard system could include only one suspension member (on only one side of the skateboard) and in other cases the skateboard could include two, as in the drawings. In implementations the braking members disclosed herein could be on either end of the skateboard, tail or nose, and/or braking mechanisms could be provided on both ends.

In implementations wherein the terms "vertical," "upward," "downward," "horizontal," and the like are used herein, they are relative to the ground when the skateboard is resting on the ground with wheels down—horizontal accordingly means parallel, or substantially parallel, with the ground, while vertical is orthogonal, or substantially orthogonal, to the ground. Upward is orthogonal to the ground and away from the ground, downward is orthogonal to the ground and toward the ground, etc.

In implementations herein wherein "substantially" is used, it means not deviating by more than 80%. For example, substantially orthogonal means at least 80% orthogonal, substantially flush means at least 80% flush (or 80% contact between two surfaces), and so forth.

The phrase "skateboard system" may apply to subsets of the systems shown in the drawings. For example, a suspension plate itself may be a skateboard system, and skateboard systems may or may not include a deck, a truck, a hanger, wheels, and so forth.

The term "installed configuration" as used herein means a configuration wherein a suspension plate is mounted to a skateboard deck, a truck or hanger is mounted to the suspension plate, and wheels are coupled with the truck or hanger.

The term "largest flat planar surface" of a portion, as used herein, means that no other flat planar surfaces of that portion are larger, but does not necessarily mean that all other flat planar surfaces of that portion are smaller. For example, such a portion may have another flat planar surface that is the same size as the one that is called the "largest flat planar surface," in which case that portion may have two largest flat planar surfaces. In some cases where angles are described herein between portions of suspension members and/or between a portion of a suspension member and a skateboard deck, such angles may also be described as existing between the largest flat planar surfaces of the portions of the suspension member, or between a largest flat planar surface of a portion of a suspension member and the deck.

In implementations herein wherein the suspension member is described as being configured to flex to reduce an angle between a portion or surface of the suspension member and the deck, including in the claims, the stated angle reduction amount may be in part due to the flexion of the suspension member and in part due to the flexion of the deck.

In implementations each of the first portion, second portion, third portion, and fourth portion (if included) of a suspension member are fully flat or substantially flat (not varying from 80% flat).

In implementations wherein the claims refer to a lever without specifying as to whether a brake lever or activation lever is meant, the term includes either type of lever.

The suspension members, as disclosed above, are heat treated (and/or treated in other ways) to have a certain hardness and also to maintain spring properties. In use the skateboard systems leverage the flexion of both the suspension members and the skateboard deck to create a controlled suspension environment. The systems provide increased shock absorption for improved ride experience, along with the suspension members twisting in response to the leaning of the rider to provide increased responsiveness and turning from the system as a whole. The rider is able to control the compression of the suspension members through the application of force on the tail or nose of the board, such as by leaning back or leaning forward, or leaning to either side.

By inserting brake pads in this controlled environment, the rider is able to lean back or lean forward (depending on the location of the brake member), compress the system, and bring the brake pad in contact with the skateboard wheels. When in motion, this rider-applied frictional contact on the wheels allows for speed regulation and braking.

The rider may control the range of flexion and suspension of the skateboard systems though force applied to the skateboard deck, allowing for increased responsiveness and maneuverability. As the rider leans from one side of the board to the other perpendicular to the direction of the board (toeside & heelside), the rider-applied force on the skateboard deck causes torsion in the mounted suspension member which transfers the action to the skateboard truck and wheel assembly.

The skateboard truck and wheel assembly, twisted to make a more aggressive pivot, provides the rider with a tighter turn radius. Coupled with the suspension-enabled shock absorption, the systems allow for smoother turning which creates higher turn speeds.

Increased responsiveness of the systems allows for more efficient pumping or carving, an action in which the rider alternates from toeside to heelside in order to control speed and propel the skateboard forward. This not only allows for a more efficient use of force when pumping, but also provides the rider with a significantly more enjoyable ride, closer to the experience of surfing or snowboarding.

A skateboard system can include only a single suspension member, mounted toward a single end of a skateboard, but a system can also include two suspension members, mounted toward both ends, for maximized ride quality. When two suspension members are installed on a deck, this creates a board-wide suspension system, with the rider leveraging the centrally located mounting locations (between suspension members and deck) as a fulcrum to pivot about using the skateboard deck.

The suspension members allow for a controlled suspension environment between the skateboard deck and a truck assembly or hanger. This environment is directly affected by the deliberate force of the rider, when applied towards the nose or tail or either side of the board, simply by leaning back or forward or to either side. This deliberate force is translated through the controlled suspension member environment to, in turn, create an expanding and contracting environment between the skateboard deck and skateboard wheels, which are mounted to the skateboard truck assembly or hanger.

Systems with braking members leverage the controlled environment of the suspension members to give the rider direct control over the speed of the entire system. The rider can apply a range of force, causing a range of speed reduction from slowing down or maintaining speed to complete stopping force. This allows for increased safety in potentially dangerous situations where the rider may experience uncontrolled speeds, while remaining unobtrusive and mounted beneath the skateboard deck with the controlled suspension environment.

The braking members/systems using axles/pivots or other braking mechanisms allow for increased vertical clearance above the wheels. This removes turning restrictions of wheel bite, wherein the skateboard deck unintentionally makes contact with the skateboard wheels during extreme turns and causes the system to come to an uncontrolled, abrupt stop. It is also pointed out that, even without the braking mechanisms, the increased vertical clearance from the suspension members alone may reduce the likelihood of wheel bite.

The suspension members are configured (through heat treatment or other techniques) to maintain spring properties so that they can repeatedly flex toward the deck, away from the deck, twist, be extended, contracted, and so forth, and repeatedly return to the same original resting state. The deflection and returning of the suspension members, leveraged against the opposing, distinct flexion of the skateboard deck, creates a suspension system for skateboards. In implementations the skateboard systems with suspension members reduce impact and increase speed retention over uneven terrain, providing a smoother and more efficient riding experience.

The skateboard systems with suspension members may provide a smoother transition from forward movement to turning via the rider's leaning. The systems may allow for forces from more directions (multi-directional forces from rider motion) to be applied to the skateboard to control the motion of the skateboard than is possible with a conventional skateboard.

When the rider leans from one side of the board to the other (toeside & heelside), perpendicular to the direction of travel of the board, the skateboard deck's lateral movement causes longitudinal twisting of the suspension member, allowing for increased responsiveness and maneuverability when amplified towards the wheels.

The suspension members decrease the skateboard's turning radius, allowing for the system to take tighter turns. Because the suspension members absorb shock, this allows for smoother and faster turns.

Increased responsiveness of the systems allow for more efficient pumping, an action in which the rider alternates from toeside to heelside in order to propel the system forward.

When two suspension members are used, it creates a single pivot platform in or near the midpoint of the skateboard deck. The mounting locations of the suspension members together act as a fulcrum, allowing the rider and the skateboard deck to pivot about the midpoint of the system. The fulcrum may be leveraged using either end of the skateboard deck as a pivot lever.

The flexion of the suspension members allows for the reduction of the suspended distance between the skateboard deck and the skateboard wheels. The flexion of the suspension members, combined with the flexion of the skateboard deck, provides a more effective full system compression. The systems are directly controlled via the rider's application of force on one or more ends or sides of deck, such as leaning on the tail, nose, or heelside/toeside (or alternating between such positions).

When the rider applies deliberate force towards one end of the board beyond the fulcrum, the system allows for the force on the skateboard deck to be transferred through a controlled environment towards the skateboard truck and wheel assembly or hanger and wheel assembly.

The systems allow for a direct transfer of rider-applied force on one end of the skateboard deck, about the fulcrum, to be applied as frictional contact between brake pad(s) and the skateboard wheels.

The braking systems/members allows for a range of frictional force to be applied from the rider in a controlled manner to the skateboard wheels. The braking systems/members allow the rider to apply a range of force to the end of a skateboard deck and mechanically regulate speed through a controlled system via adjustments in foot placement and force applied.

The brake pads may comprise or consist of a rubber consumable of varying durometers. In implementations the brake pad could be formed of a same material as a brake lever (such as a metal). The brake pad(s) may be mounted to one or more brake levers.

The systems disclosed herein provide a shock-absorbing, fluid turning, full-board experience on land that simulates other sports such as surfing on water or snowboarding on snow.

While any truck assemblies may be used together with the skateboard systems disclosed herein, in implementations CADILLAC nine-inch retro-style trucks may further facilitate carving and surf performance compared to conventional street trucks, and may provide desired stability and turning properties.

When angles between portions of suspension members are discussed herein, it is to be understood that there are two angles between any two portions, the angles being measured between planes that are coplanar with the portions, the two angles adding up to 180 degrees, and that either specific angle may be referred to.

In implementations of suspension members 116 and 140, in a resting non-flexed configuration: the first portion and second portion may be offset (in other words offset from being coplanar) from one another by thirty degrees, or by twenty to forty degrees, or by fifteen to forty-five degrees, or by ten to fifty degrees, or by five to sixty degrees, or by five to seventy degrees, or by five to eighty degrees, or by any other range between zero and ninety degrees; and the second portion and third portion may be offset from one another by thirty degrees, or by thirty-five degrees, or by thirty to forty degrees, or by twenty to fifty degrees, or by fifteen to fifty-five degrees, or by ten to sixty degrees, or by five to seventy degrees, or by five to eighty degrees, or by any other range between zero and ninety degrees.

In implementations of suspension member 256, in a resting non-flexed configuration: the first portion and second portion may be offset from one another by thirty degrees, by twenty-five to thirty-five degrees, by twenty to forty degrees, by fifteen to forty-five degrees, by ten to fifty degrees, by five to fifty-five degrees, by five to sixty degrees, by five to seventy degrees, by five to eighty degrees, or by any other range between zero and ninety degrees; the second and third portions may be offset from one another by 45 degrees, by forty to fifty degrees, by thirty-five to fifty-five degrees, by thirty to sixty degrees, by twenty-five to sixty-five degrees, by twenty to seventy degrees, by fifteen to seventy-five degrees, by ten to eighty degrees, by five to eighty-five degrees, or by any other range between zero and ninety degrees, and; the third and fourth portions may be offset from one another by forty degrees, by forty-five degrees, by fifty-degrees, by fifty-five degrees, by sixty degrees, by forty to sixty degrees, by thirty-five to sixty-five degrees, by thirty to seventy degrees, by twenty-five to seventy-five degrees, by twenty to eighty degrees, by fifteen to eighty-five degrees, by ten to eighty-five degrees, by five to eighty-five degrees, or by any other range between zero and ninety degrees.

In places where the phrase "one of A and B" is used herein, including in the claims, wherein A and B are elements, the phrase shall have the meaning "A and/or B." This shall be extrapolated to as many elements as are recited in this manner, for example the phrase "one of A, B, and C" shall mean "A, B, and/or C," and so forth. To further clarify, the phrase "one of A, B, and C" would include implementations having: A only; B only; C only; A and B but not C; A and C but not B; B and C but not A; and A and B and C.

In places where the description above refers to specific implementations of skateboard systems and methods, one or more or many modifications may be made without departing from the spirit and scope thereof. Details of any specific implementation/embodiment described herein may, wherever possible, be applied to any other specific implementation/embodiment described herein. The appended claims are to encompass within their scope all such changes and modifications as are within the true spirit and scope of this disclosure.

Furthermore, in the claims, if a specific number of an element is intended, such will be explicitly recited in the claim, and in the absence of such explicit recitation no such limitation exists. For example, the claims may include phrases such as "at least one" and "one or more" to introduce claim elements. The use of such phrases should not be construed to imply that the introduction of any other claim element by the indefinite article "a" or "an" limits that claim to only one such element, and the same holds true for the use in the claims of definite articles.

Additionally, in places where a claim below uses the term "first" as applied to an element, this does not imply that the claim requires a second (or more) of that element—if the claim does not explicitly recite a "second" of that element, the claim does not require a "second" of that element. Furthermore, in some cases a claim may recite a "second" or "third" or "fourth" (or so on) of an element, and this does not imply that the claim requires a first (or so on) of that element—if the claim does not explicitly recite a "first" (or so on) of that element, the claim does not require a "first" (or so on) of that element.

What is claimed is:

1. A skateboard system, comprising:

a first suspension member comprising:

a first portion having a flat planar surface configured to mate flush with an underside of a deck of a skateboard, the first portion comprising a plurality of mount holes configured to allow mounting of the first portion with the deck;

a second portion having a flat planar surface angled between fifteen and sixty degrees relative to the flat planar surface of the first portion and relative to the deck in an installed configuration; and a third portion having a flat planar surface angled between fifteen and sixty degrees relative to the flat planar surface of the second portion, the third portion comprising at least one opening configured to mount one of a skateboard truck assembly and a skateboard hanger with the third portion;

wherein the first suspension member is configured to increase a vertical distance between the deck and a wheel of the skateboard in the installed configuration, relative to a configuration where the skateboard truck assembly is mounted directly with the deck; and wherein the first suspension member is configured to flex, such that an angle between the flat planar surface of the second portion and the deck decreases by between five and thirty degrees in response to a first downward force on the deck, the first downward force provided at least in part by a user's feet during riding.

2. The system of claim 1, wherein all of the first suspension member is formed from a single piece of metal.

3. The system of claim 2, wherein the single piece of metal comprises a Rockwell hardness between 35 and 55.

4. The system of claim 1, wherein the first portion, the second portion, and the third portion are each substantially flat.

5. The system of claim 4, wherein the first portion, the second portion, and the third portion are each fully flat.

6. The system of claim 1, wherein the second portion is configured to flex in a direction opposite a direction of flexion of the deck in response to the first downward force.

7. The system of claim 1, wherein the first suspension member is configured to twist in response to the user alternating between a toeside downward force and a heelside downward force, the twisting configured to assist propelling the skateboard.

8. The system of claim 1, further comprising a braking member configured to mount with the first suspension member, the braking member configured to abut the wheel of the skateboard in response to a second downward force on the deck, the second downward force provided at least in part by the user's feet during riding.

9. The system of claim 8, wherein the braking member comprises a lever configured to rotate, to abut the braking member to the wheel, in response to the second downward force.

10. The system of claim 1, further comprising the deck and a second suspension member, wherein a distance between a mounting location of the first suspension member to the deck and a mounting location of the second suspension member to the deck, in the installed configuration, comprises a length less than half a longest length of the deck.

11. The system of claim 10, wherein the distance between the mounting location of the first suspension member to the deck and the mounting location of the second suspension member to the deck comprises a length less than a third the longest length of the deck.

12. A skateboard system, comprising:

a first suspension member comprising:

a first portion having a flat planar surface configured to mate flush with an underside of a deck of a skateboard, the first portion comprising a plurality of mount holes configured to allow mounting of the first portion with the deck;

a second portion having a flat planar surface angled between fifteen and sixty degrees relative to the flat planar surface of the first portion and relative to the deck in an installed configuration; and a third portion having a flat planar surface angled between fifteen and sixty degrees relative to the flat planar surface of the second portion, the third portion comprising a plurality of mount holes sized and spaced to align with mount holes of a skateboard truck assembly to facilitate mounting of the skateboard truck assembly with the third portion;

wherein the first suspension member is configured to increase a vertical distance between the deck and a wheel of the skateboard, in the installed configuration, relative to a configuration where the skateboard truck assembly is mounted directly with the deck; and wherein the first suspension member is configured to flex, such that an angle between the flat planar surface of the second portion and the deck decreases by between five and thirty degrees, in response to a first downward force on the deck, the first downward force provided at least in part by a user's feet during riding.

13. The system of claim 12, further comprising an opening in the third portion providing access to a kingpin bolt of the skateboard truck assembly when the skateboard truck assembly is mounted with the first suspension member.

14. The system of claim 12, wherein the flat planar surface of the first portion is within fifteen degrees of being parallel with the flat planar surface of the third portion when the first suspension member is in a non-flexed state.

15. The system of claim 12, wherein all of the first suspension member consists of a single flat piece of metal with bends to separate the first portion, the second portion, and the third portion, and a plurality of openings through the single flat piece of metal including the plurality of mount holes of the first portion and the plurality of mount holes of the third portion.

16. A skateboard system, comprising:

a first suspension member comprising:

a first portion having a flat planar surface configured to mate flush with an underside of a deck of a skateboard, the first portion comprising a plurality of mount holes configured to allow mounting of the first portion with the deck;

a second portion having a flat planar surface angled between fifteen and sixty degrees relative to the flat planar surface of the first portion and relative to the deck in an installed configuration;

a third portion having a flat planar surface angled between fifteen and sixty degrees relative to the flat planar surface of the second portion, the third portion comprising an opening sized to receive a kingpin bolt for coupling a skateboard hanger with the third portion; and a fourth portion having a flat planar surface angled between fifteen and eighty degrees relative to the flat planar surface of the third portion, the fourth portion comprising one of a pivot cup configured to receive a pivot member of the skateboard hanger and an opening configured to receive the pivot cup;

wherein the first suspension member is configured to increase a vertical distance between the deck and a wheel of the skateboard in the installed configuration, relative to a configuration where a skateboard truck assembly comprising the skateboard hanger is mounted directly with the deck; and wherein the first suspension member is configured to flex, such that an angle between the flat planar surface of the second portion and the deck decreases by between five and thirty degrees, in response to a first downward force on the deck, the first downward force provided at least in part by a user's feet during riding.

17. The system of claim 16, wherein the first portion, the second portion, the third portion and the fourth portion are each substantially flat.

18. The system of claim 16, wherein the pivot cup is fixedly coupled with the fourth portion.

19. The system of claim 16, wherein, going in a direction from the first portion to the fourth portion, in the installed configuration the first portion is flush with the deck, the second portion is angled downward away from the deck, the third portion is angled upward towards the deck, and the fourth portion is angled downward away from the deck.

20. The system of claim 16, further comprising the kingpin bolt, wherein the kingpin bolt comprises a stepped configuration forming a surface configured to mate with a surface of a bushing through which the kingpin bolt passes when the first suspension member is in the installed configuration.

* * * * *